US007744492B2

(12) United States Patent
Nanba et al.

(10) Patent No.: US 7,744,492 B2
(45) **Date of Patent: *Jun. 29, 2010**

(54) MULTI-PIECE SOLID GOLF BALL

(75) Inventors: Atsushi Nanba, Chichibu (JP); Hiroshi Higuchi, Chichibu (JP); Tooru Ogawana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 28 days.

This patent is subject to a terminal disclaimer.

(21) Appl. No.: 12/184,514

(22) Filed: Aug. 1, 2008

(65) Prior Publication Data

US 2009/0036233 A1 Feb. 5, 2009

Related U.S. Application Data

(63) Continuation-in-part of application No. 11/831,396, filed on Jul. 31, 2007, now Pat. No. 7,425,182.

(51) Int. Cl.
*A63B 37/06* (2006.01)

(52) U.S. Cl. ..... 473/376

(58) Field of Classification Search ..... 473/376, 473/368, 373, 374, 367
See application file for complete search history.

(56) References Cited

U.S. PATENT DOCUMENTS

| | | | |
|---|---|---|---|
| 5,306,760 | A | 4/1994 | Sullivan |
| 5,312,857 | A | 5/1994 | Sullivan |
| 5,553,852 | A | 9/1996 | Higuchi et al. |
| 5,779,563 | A | 7/1998 | Yamagishi et al. |
| 5,782,707 | A | 7/1998 | Yamagishi et al. |
| 5,899,822 | A | 5/1999 | Yamagishi et al. |
| 6,056,650 | A | 5/2000 | Yamagishi et al. |
| 6,117,025 | A | 9/2000 | Sullivan |
| 6,152,834 | A | 11/2000 | Sullivan |
| 6,248,028 | B1 | 6/2001 | Higuchi et al. |
| 6,267,692 | B1 | 7/2001 | Higuchi et al. |
| 6,267,694 | B1 | 7/2001 | Higuchi et al. |
| 6,533,683 | B2 | 3/2003 | Watanabe |
| 6,592,471 | B1 | 7/2003 | Watanabe et al. |
| 6,656,059 | B2 | 12/2003 | Umezawa et al. |
| 6,659,889 | B2 | 12/2003 | Kasashima et al. |
| 6,663,507 | B1 | 12/2003 | Watanabe et al. |

(Continued)

FOREIGN PATENT DOCUMENTS

| | | |
|---|---|---|
| JP | 2002-765 A | 1/1990 |

(Continued)

*Primary Examiner*—Raeann Trimiew
(74) *Attorney, Agent, or Firm*—Sughrue Mion, PLLC

(57) ABSTRACT

The present invention provides a multi-piece solid golf ball having a core obtained by molding under heat a specific rubber composition and having a cover of at least three layers which encases the core. By optimizing the deflection of the core under a specific load, optimizing the hardness at the center of the core and the hardnesses of the innermost cover layer, outermost cover layer and intermediate cover layer, setting the combined thickness of the cover layers to at least a specific value, and forming the innermost cover layer of a highly neutralized ionomer resin composition, a sufficient reduction in the spin rate of the ball on shots taken with a driver can be achieved, enabling the distance traveled by the ball to be increased.

7 Claims, 1 Drawing Sheet

U.S. PATENT DOCUMENTS

Figure 1:
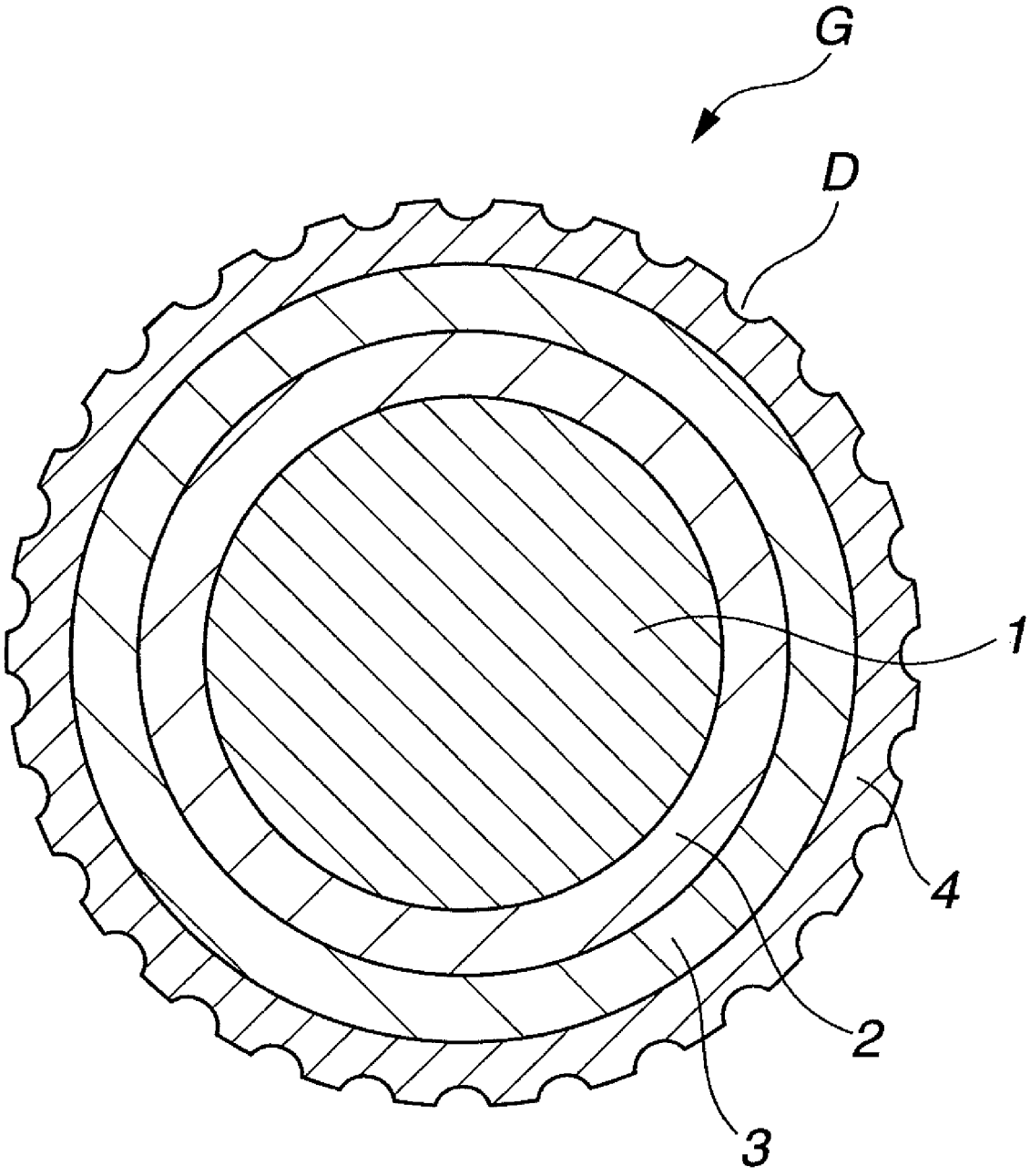

| | | | | |
|---|---|---|---|---|
| 6,679,791 | B2 | 1/2004 | Watanabe | |
| 6,702,694 | B1 | 3/2004 | Watanabe | |
| 6,702,695 | B1 | 3/2004 | Higuchi et al. | |
| 6,723,008 | B2 | 4/2004 | Higuchi et al. | |
| 6,739,986 | B2 | 5/2004 | Higuchi et al. | |
| 6,746,345 | B2 | 6/2004 | Higuchi et al. | |
| 6,746,347 | B2 | 6/2004 | Higuchi et al. | |
| 6,814,917 | B1 | 11/2004 | Watanabe et al. | |
| 7,140,979 | B2 | 11/2006 | Umezawa et al. | |
| 7,140,980 | B2 | 11/2006 | Umezawa et al. | |
| 7,425,182 | B1 * | 9/2008 | Nanba et al. | 473/376 |
| 7,488,262 | B1 * | 2/2009 | Nanba et al. | 473/376 |
| 2002/0119840 | A1 | 8/2002 | Higuchi et al. | |

FOREIGN PATENT DOCUMENTS

| | | | |
|---|---|---|---|
| JP | 7024085 | A | 1/1995 |
| JP | 9-215775 | A | 8/1997 |
| JP | 10-151226 | A | 6/1998 |
| JP | 2910516 | B2 | 4/1999 |
| JP | 2002-85587 | A | 3/2002 |
| JP | 2002-85588 | A | 3/2002 |
| JP | 2002-85589 | A | 3/2002 |
| JP | 2002-186686 | A | 7/2002 |
| JP | 2002-191721 | A | 7/2002 |
| JP | 2002-219196 | A | 8/2002 |
| JP | 2002-315848 | A | 10/2002 |
| JP | 2002-345999 | A | 12/2002 |
| JP | 2003-190330 | A | 7/2003 |
| JP | 3516123 | B2 | 1/2004 |
| JP | 3516124 | B2 | 1/2004 |
| JP | 3516125 | B2 | 1/2004 |
| JP | 2004-049913 | A | 2/2004 |
| JP | 2004-97802 | A | 4/2004 |
| JP | 3601582 | B2 | 10/2004 |
| JP | 3661812 | B2 | 4/2005 |
| JP | 3674679 | B2 | 5/2005 |
| JP | 2005-224514 | A | 8/2005 |
| JP | 2005-224515 | A | 8/2005 |
| WO | 98/46671 | A1 | 10/1998 |

* cited by examiner

MULTI-PIECE SOLID GOLF BALL

CROSS-REFERENCE TO RELATED APPLICATION

This application is a continuation-in-part of copending application Ser. No. 11/831,396 filed on Jul. 31, 2007, now U.S. Pat. No. 7,425,182 the entire contents of which are hereby incorporated by reference.

BACKGROUND OF THE INVENTION

The present invention relates to a multi-piece golf ball having a core and three or more cover layers. More specifically, the invention relates to a multi-piece solid golf ball which has a high initial velocity on shots taken with a driver and a good spin performance on approach shots.

Numerous golf balls with multilayer covers have hitherto been disclosed. For example, various golf balls with multilayer covers are described in U.S. Pat. Nos. 5,833,553, 6,126,559, 6,220,972, 6,561,928 and 6,309,314. However, these prior-art golf balls do not have a good spin receptivity on approach shots near the green.

A multilayer golf ball is disclosed in U.S. Pat. No. 6,585,608, but this ball has a poor controllability on approach shots.

In the golf balls with multilayer covers disclosed in U.S. Pat. Nos. 5,779,562, 6,117,025, 6,152,834, 6,394,914, 6,213,895 and 6,994,638, the hardness relationships within the multilayer cover have been optimized. Yet, it has been difficult to achieve a sufficiently high initial ball velocity on shots taken with a driver, particularly on shots taken with a driver at a high head speed.

Up until now, golf balls obtained by using a conventional ionomer resin to form the innermost cover layer which directly encases the core have not had a good rebound. To compensate, one known approach has been to reduce the spin rate by increasing the thickness of the inner cover layer made of ionomer resin. Unfortunately, this only lowers the rebound. Moreover, increasing the hardness of the intermediate cover layer so as to increase the rebound has the unfortunate effect of lowering the spin performance on approach shots.

The use of highly neutralized ionomer resins as golf ball cover materials is known to the art, but such covers are relatively thin. Although the golf balls obtained in such cases do have an improved rebound compared with golf balls obtained using prior-art ionomer resins, the spin rate-lowering effect on shots with a driver has been rather negligible.

SUMMARY OF THE INVENTION

It is therefore an object of the present invention to provide a multi-piece solid golf ball which, compared with golf balls made with cover materials that use conventional ionomer resins, has an improved ball rebound, has a spin rate on shots taken with a driver that is sufficiently reduced, thereby increasing the total distance traveled by the ball, and also has an excellent spin rate on approach shots.

As a result of extensive investigations, the inventor has discovered that, in multi-piece solid golf balls having four or more layers, by forming the innermost layer of the cover primarily of a highly neutralized ionomer and also increasing the thickness of the multilayer cover, the rebound of the ball is improved and a spin rate-lowering effect is achieved on shots taken with a driver. In other words, a distance-increasing effect is achieved. Moreover, the inventor has also found that, because the ball rebound is improved by the innermost cover layer, there is no need to increase the hardness of the intermediate cover layer, thus resulting in an excellent spin performance on approach shots.

Accordingly, the invention provides the following multi-piece solid golf balls.

[1] A multi-piece solid golf ball comprising a core obtained by molding under heat a rubber composition comprising a base rubber, a filler, an organic peroxide, an antioxidant and an α,β-unsaturated carboxylic acid, and a cover of at least three layers which encases the core and in which the cover layers other than an outermost cover layer are formed primarily of a thermoplastic resin, wherein the core has a deflection when compressed under a final load of 1,275 N (130 kgf) from an initial load state of 98 N (10 kgf) of 3.2 mm or less; at least one intermediate cover layer situated between an innermost cover layer and an outermost cover layer has a higher hardness than the innermost cover layer and the outermost cover layer; the innermost cover layer and the core have a difference in specific gravity therebetween of 0.1 or less; the core has a Shore D center hardness (A) which satisfies the following condition with respect to the Shore D hardness (B) of the innermost cover layer:

$$A > B - 10;$$

the cover layers have a combined thickness of at least 3.5 mm; and the innermost cover layer is made of a resin composition comprising 100 parts by weight of one or both (a) and (d) below:

(a) an olefin-unsaturated carboxylic acid random copolymer and/or an olefin-unsaturated carboxylic acid-unsaturated carboxylic acid ester random copolymer and (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 150 parts by weight of a fatty acid or fatty acid derivative having a molecular weight of at least 228, and (c) from 0.1 to 10 parts by weight of a basic inorganic metal compound which is capable of neutralizing acid groups in components (a) and/or (d) and in component (b).

[2] The multi-piece solid golf ball of [1], wherein at least one intermediate cover layer situated between the innermost cover layer and the outermost cover layer is made of a resin composition comprising said components (a) to (d).

[3] The multi-piece solid golf ball of [1], wherein the resin composition making up the innermost cover layer further comprises:

(e) a thermoplastic elastomer selected from the group consisting of thermoplastic polyester elastomers, thermoplastic block copolymers and thermoplastic urethanes, (f) a thermoplastic block copolymer containing end blocks modified by a functional group having reactivity with an ionomer resin, both end blocks being formed of different comonomers, and (g) an inorganic filler which is non-reactive with an ionomer resin.

[4] The multi-piece solid golf ball of [1] wherein, of components (a) and (d), the resin material which is composed of an olefin-unsaturated carboxylic acid random copolymer (binary random copolymer) and/or a metal salt thereof has a Shore D hardness of 58 or more, and the resin material which is composed of an olefin-unsaturated carboxylic acid-unsaturated carboxylic acid ester random copolymer (ternary random copolymer) and/or a metal salt thereof has a Shore D hardness of 55 or less.

[5] The multi-piece solid golf ball of [1], wherein the core is composed of an inner sphere and an outer core layer, the inner sphere having a center hardness in Shore D units of from 21 to 46, a surface hardness in Shore D units of from 33 to 56, and a Shore D hardness difference between the surface and the center of at least 5, and the outer core layer having a cross-sectional hardness 1 mm outside of a boundary between the inner sphere and the outer core layer, in Shore D units, of from 43 to 66, and having a surface hardness in Shore D units of from 50 to 70.

[6] The multi-piece solid golf ball of [1], wherein the outermost cover layer is formed primarily of polyurethane.

[7] The multi-piece solid golf ball of [1], wherein the outermost cover layer is formed primarily of a thermoplastic polyurethane.

BRIEF DESCRIPTION OF THE DIAGRAMS

FIG. 1 is a schematic cross-sectional view of a multi-piece solid golf ball (four-layer construction) according to one embodiment of the invention.

DETAILED DESCRIPTION OF THE INVENTION

The invention is described more fully below.

The multi-piece solid golf ball of the invention is a multi-layer structure having a core and a cover of three or more layers which encases the core.

The core in the invention may be a rubber core that has been molded and vulcanized from a rubber composition containing primarily a commonly used base rubber. Specifically, a material molded and vulcanized from a rubber composition containing a base rubber, a filler, an organic peroxide, an antioxidant and an α,β-unsaturated carboxylic acid serves as the golf ball core.

It is preferable here for the core to be made of a rubber composition. Polybutadiene is preferably used as the base rubber in the rubber composition. A preferred example of this polybutadiene is 1,4-cis polybutadiene having a cis structure content of at least 40%. If desired, other types of rubber, such as natural rubber, polyisoprene rubber or styrene-butadiene rubber may be suitably blended with the foregoing polybutadiene in this base rubber. The rebound of the golf ball can be improved by increasing the amount of the rubber ingredients.

An α,β-unsaturated carboxylic acid compound such as zinc methacrylate or zinc acrylate may be included in the rubber composition as a crosslinking agent. The use of zinc acrylate is especially preferred. The amount of such unsaturated carboxylic acid compounds included per 100 parts by weight of the base rubber is set to preferably at least 10 parts by weight, and more preferably at least 20 parts by weight, but preferably not more than 50 parts by weight, and more preferably not more than 39 parts by weight.

A vulcanizing agent is included in the rubber composition. The vulcanizing agent used is preferably an organic peroxide and/or sulfur. Illustrative examples of the organic peroxide include commercial products such as Perhexa 3M (produced by NOF Corporation), Percumyl D (produced by NOF Corporation), and Luperco 231XL and Luperco 101XL (both products of Atochem Co.). Any one or mixtures of two or more of these may be used. The amount included per 100 parts by weight of the base rubber is preferably at least 0.2 part by weight, more preferably at least 0.4 part by weight, and even more preferably at least 0.6 part by weight, but preferably not more than 2.0 parts by weight, more preferably not more than 1.5 parts by weight, even more preferably not more than 1.2 parts by weight, and most preferably not more than 0.9 part by weight.

In addition, an antioxidant is included. Illustrative examples of the antioxidant include commercial antioxidants such as Nocrac NS-6, Nocrac NS-30 and Nocrac SP-N (all products of Ouchi Shinko Chemical Industry Co., Ltd.), and Yoshinox 425 (produced by Yoshitomi Pharmaceutical Industries, Ltd.). These may be used singly or as combinations of two or more thereof.

Illustrative, non-limiting, examples of the filler included in the rubber composition are zinc oxide, barium sulfate and calcium carbonate.

The core composition obtained by compounding the above ingredients is generally masticated using a mixing apparatus such as a Banbury mixer or roll mill, following which the masticated material is compression-molded or injection-molded in a core mold, and the resulting molded body is cured by suitably heating at a temperature sufficient for the crosslinking agent and co-crosslinking agent to act, thereby producing a core having the desired hardness profile. To illustrate, when dicumyl peroxide is used as the crosslinking agent and zinc acrylate is used as the co-crosslinking agent, heating is typically carried out at from 130 to 170° C., and preferably from 150 to 160° C., for a period of from 10 to 40 minutes, and preferably from 12 to 20 minutes.

The core may be produced by using a known method to vulcanize and cure the rubber composition. The diameter of the core is set to preferably at least 32.3 mm, and more preferably at least 32.5 mm, but preferably not more than 35.5 mm, and more preferably not more than 35.0 mm.

The core must have a deflection, when compressed under a final load of 1,275 N (130 kgf) from an initial load state of 98 N (10 kgf), of 3.2 mm or less, preferably 3.1 mm or less, and more preferably 3.0 mm or less. The lower limit in the deflection is preferably 2.6 mm or more. If the core is softer than the above range, the core will have a poor rebound. Conversely, if the core is harder than the above range, the ball may have a poor feel on impact.

The core may be created as a plurality of layers. By having the core composed of a plurality of layers, the spin rate on shots with a driver can be lowered, enabling a further increase in distance to be achieved. Moreover, the spin performance and feel at the time of impact can be improved. In such a case, the core has an inner core layer (inner sphere) and an outer core layer. Details on the inner core layer and the outer core layer are given below.

The inner core layer has a diameter of at least 15 mm, preferably at least 20 mm, more preferably at least 22 mm, and even more preferably at least 24 mm, but not more than 36 mm, preferably not more than 33 mm, more preferably not more than 30 mm, and even more preferably not more than 28 mm.

Also, the inner core layer has a center hardness, in Shore D hardness units, of at least 21, preferably at least 23, more preferably at least 24, and even more preferably at least 26, but not more than 48, preferably not more than 47, more preferably not more than 46, and even more preferably not more than 45.

The inner core layer has a surface hardness in Shore D hardness units of at least 33, preferably at least 35, more preferably at least 37, and even more preferably at least 39, but not more than 56, preferably not more than 55, more preferably not more than 54, and even more preferably not more than 53.

Moreover, the value obtained by subtracting the inner core layer center hardness from the inner core layer surface hardness, in Shore D hardness units, is at least 5, preferably at least 6, and more preferably at least 7, but preferably not more than 21, and more preferably not more than 19.

The outer core layer has a thickness of preferably at least 1.5 mm, more preferably at least 2 mm, even more preferably at least 2.5 mm, and most preferably at least 3 mm, but preferably not more than 10 mm, more preferably not more than 9 mm, even more preferably not more than 8 mm and most preferably not more than 7 mm.

The outer core layer has a cross-sectional hardness 1 mm outside of a boundary between the inner core layer and the outer core layer, in shore D units, of at least 43, preferably at least 45, and more preferably at least 47, but not more than 66, preferably not more than 64, and more preferably not more than 62.

The outer core layer has a surface hardness, in Shore D units, of at least 50, preferably at least 52, more preferably at least 54, and even more preferably at least 56, but not more than 70, preferably not more than 68, and more preferably not more than 66.

The value obtained by subtracting the center hardness of the inner core layer from the surface hardness of the outer core layer, in Shore D units, is preferably at least 15, more preferably at least 18, and even more preferably at least 20, but preferably not more than 40, more preferably not more than 35, and even more preferably not more than 30. Adjusting the hardness in this way, combined with selection of the above-indicated materials, enables a solid golf ball having both a soft feel on impact and a good rebound to be reliably obtained.

The inner core layer and/or the outer core layer may be formed using a rubber composition containing, for example, a co-crosslinking agent, an organic peroxide, an inert filler and an organosulfur compound. It is preferable to use polybutadiene as the base rubber of this rubber composition.

In cases where the golf ball has a two-layer core, the outer core layer may be formed by compression molding or injection molding. Alternatively, a multilayer core may be manufactured by placing an unvulcanized rubber composition in a half cup-forming mold, rendering the composition into a semi-vulcanized state at a temperature of from 100 to 160° C. for a period of from 1 to 10 minutes, then joining together two of the resulting semi-vulcanized half-cups so as to encase therein the inner core layer (inner sphere), and once again molding under applied pressure within a mold at a temperature of from 100 to 200° C. for a period of from 5 to 20 minutes, thereby uniting the inner core layer and the outer core layer.

The "diameter" and the "deflection when compressed under a final load of 1,275 N (130 kgf) from an initial load state of 98 N (10 kgf)" of the foregoing multilayer core as a whole are the same as the earlier mentioned core diameter and deflection.

In the practice of the invention, a cover of at least three layers encases the core. That is, referring to FIG. 1, the ball has a construction in which the cover consists of an innermost cover layer 2 which directly envelopes a core 1, an outermost cover layer 4 which is positioned on the surface side of the ball, and at least one intermediate cover layer 3 which is situated between the innermost cover layer 2 and the outermost cover layer 4. Generally, a plurality of dimples D are formed on the outside surface of the outermost cover layer 4.

Next, the materials making up the respective cover layers are described in detail below, beginning with the innermost cover layer and followed in turn by the outermost cover layer and the intermediate cover layer(s).

Material of Innermost Cover Layer

In the invention, the innermost cover layer is made of a resin composition which includes as the essential components:

100 parts by weight of one or a mixture of (a) an olefin-unsaturated carboxylic acid random copolymer and/or an olefin-unsaturated carboxylic acid-unsaturated carboxylic acid ester random copolymer, and (d) a metal ion neutralization product of an olefin-unsaturated carboxylic acid random copolymer and/or a metal ion neutralization product of an olefin-unsaturated carboxylic acid-unsaturated carboxylic acid ester random copolymer;

(b) from 5 to 150 parts by weight of a fatty acid or fatty acid derivative having a molecular weight of at least 228; and (c) from 0.1 to 10 parts by weight of a basic inorganic metal compound which is capable of neutralizing acid groups in components (a) and/or (d) and in component (b).

Above components (a) to (d) are described below.

Component (a) is an olefin-unsaturated carboxylic acid random copolymer and/or an olefin-unsaturated carboxylic acid-unsaturated carboxylic acid ester random copolymer. Component (d) is a metal ion neutralization product of an olefin-unsaturated carboxylic acid random copolymer and/or a metal ion neutralization product of an olefin-unsaturated carboxylic acid-unsaturated carboxylic acid ester random copolymer. Either of these components may be used alone or above components (a) and (d) may be used together.

The olefin in component (a) has a number of carbons which is generally at least 2 but not more than 8, and preferably not more than 6. Specific examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

The unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component (a) may be prepared by using a known process to randomly copolymerize the above ingredients. It is recommended that the unsaturated carboxylic acid content (acid content) within the random copolymer be preferably at least 2 wt %, more preferably at least 6 wt %, and even more preferably at least 8 wt %, but preferably not more than 25 wt %, more preferably not more than 20 wt %, and even more preferably not more than 15 wt %. A low acid content may lower the resilience of the material, whereas a high acid content may lower the processability of the material.

The neutralization product of a random copolymer may be prepared as component (d) by neutralizing some of the acid groups in the above-described random copolymer with metal ions. Examples of metal ions which may neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. The use of ions such as $Na^+$, $Li^+$, Zn++ and $Mg^{++}$ is preferred. $Zn^{++}$ is especially preferred. The degree of neutralization of the random copolymer by these metal ions is not particularly limited. Such neutralization products may be prepared using a method known to the art. For example, the metal ions may be introduced onto the random copolymer using such compounds as formates, acetates, nitrates, carbonates, bicarbonates, oxides, hydroxides or alkoxides of the above metal ions.

Illustrative examples of the random copolymer serving as component (a) include Nucrel AN4311, Nucrel AN4318 and Nucrel 1560 (all produced by DuPont-Mitsui Polychemicals Co., Ltd.). Illustrative examples of the neutralization products of random copolymers serving as component (d) include Himilan 1554, Himilan 1557, Himilan 1601, Himilan 1605, Himilan 1706, Himilan 1855, Himilan 1856 and Himilan AM7316 (all products of DuPont-Mitsui Polychemicals Co., Ltd.); and also Surlyn 6320, Surlyn 7930 and Surlyn 8120 (all products of E.I. DuPont de Nemours & Company). Zinc-neutralized ionomer resins, such as Himilan AM7316, are especially preferred.

The base resin in the innermost cover layer material may use a random copolymer of the type described above for component (a), a neutralization product of the type described above for component (d), or a combination of both. Where both are used in combination, the proportions in which they are blended are not subject to any particular limitation.

Of the above components (a) and (d), the resin material composed of an olefin-unsaturated carboxylic acid random copolymer (a binary random copolymer) and/or a metal salt thereof has a Shore D hardness of preferably at least 58, and the resin material composed of an olefin-unsaturated carboxylic acid-unsaturated carboxylic acid ester random copolymer (a ternary random copolymer) and/or a metal salt thereof has a Shore D hardness of preferably 55 or less. The upper limit in the hardness of the resin material composed of the above-described binary random copolymer and/or a metal salt thereof is preferably 70 or less, and more preferably 68 or less. The lower limit in the hardness of the resin material composed of the above-described ternary random copolymer and/or a metal salt thereof is preferably at least 20, and more preferably at least 25.

Component (b) is a fatty acid or a fatty acid derivative having a molecular weight of at least 228 whose purpose is to enhance the flow properties of the resin composition. It has a molecular weight which is much smaller than that of the thermoplastic resin of component (a), and helps to significantly lower the melt viscosity of the mixture. Also, because the fatty acid (or fatty acid derivative) has a molecular weight of at least 228 and has a high content of acid groups (or derivative moieties thereof), its addition to the resin material results in little if any loss of resilience.

The molecular weight of the fatty acid or fatty acid derivative used as component (b) is at least 228, preferably at least 256, more preferably at least 280, and even more preferably at least 300, but not more than 1,500, preferably not more than 1,000, even more preferably not more than 600, and most preferably not more than 500. If the molecular weight is too small, component (b) will be unable to improve the heat resistance of the resin composition. On the other hand, if the molecular weight is too large, component (b) will be unable to improve the flow properties of the resin composition.

The fatty acid or fatty acid derivative serving as component (b) may be an unsaturated fatty acid or fatty acid derivative having a double bond or triple bond in the alkyl group, or it may be a saturated fatty acid or fatty acid derivative in which all the bonds on the alkyl group are single bonds. It is recommended that the number of carbon atoms on the molecule be preferably at least 18, more preferably at least 20, even more preferably at least 22, and most preferably at least 24, but preferably not more than 80, more preferably not more than 60, even more preferably not more than 40, and most preferably not more than 30. Too few carbons may make it impossible to achieve an improved heat resistance, and may also set the acid group content so high as to cause the acid groups to interact with acid groups present on the base resin, diminishing the flow-improving effects. On the other hand, too many carbons increases the molecular weight, which may significantly lower the flow-improving effects.

Specific examples of fatty acids that may be used as component (b) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

Fatty acid derivatives are exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Moreover, use may also be made of known metallic soap-modified ionomers, including those described in U.S. Pat. Nos. 5,312,857, 5,306,760 and International Disclosure WO 98/46671, in combination with above components (a) and/or (d) and component (b).

A basic inorganic filler capable of neutralizing acid groups in above component (a) and/or (d) and above component (b) is added as component (c). When component (a) and/or (d) and component (b) alone, and in particular a metal-modified ionomer resin alone (e.g., a metal soap-modified ionomer resin of the type mentioned in the foregoing patent publications, alone), is heated and mixed, as shown below, the metallic soap and un-neutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it will substantially lower paint film adhesion.

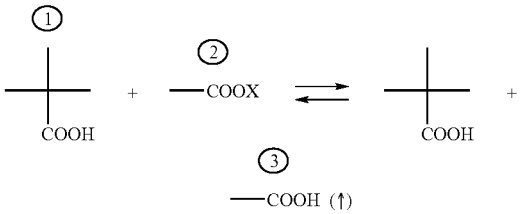

(1) un-neutralized acid group present on the ionomer resin
(2) metallic soap
(3) fatty acid
X: metal atom To solve this problem, the resin composition includes, as component (c), a basic inorganic metal compound which neutralizes the acid groups present in above components (a) and/or (d) and component (b). The inclusion of component (c) as an essential ingredient confers excellent properties. That is, the acid groups in above components (a) and/or (d) and component (b) are neutralized, and synergistic effects from the inclusion of each of these respective components increase the thermal stability of the resin composition while at the same time conferring a good moldability and enhancing the resilience as a golf ball material.

It is recommended that above component (c) be a basic inorganic metal compound, preferably a monoxide, which is capable of neutralizing acid groups in above components (a) and/or (d) and in component (b). Because such compounds have a high reactivity with the ionomer resin and the reaction by-products contain no organic matter, the degree of neutralization of the resin composition can be increased without a loss of thermal stability.

The metal ions used here in the basic inorganic metal compound are exemplified by $Li^{+}$, Nag, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide is preferred. The use of magnesium oxide, which has a high reactivity with ionomer resins, is especially preferred.

The resin composition which includes, as described above, components (a), (d), (b) and (c) can be provided with an improved thermal stability, moldability and resilience. To achieve these ends, the components must be formulated in certain proportions. Specifically, it is essential to include, per 100 parts by weight of component (a) and/or component (d) (referred to below as the "base resin"), at least 5 parts by weight, but not more than 150 parts by weight, preferably not more than 100 parts by weight, and more preferably not more than 80 parts by weight, of component (b); and at least 0.1 part by weight, but not more than 10 parts by weight, and preferably not more than 5 parts by weight, of component (c). Too little component (b) lowers the melt viscosity, resulting in a poor processability, whereas too much lowers the durability. Too little component (c) fails to improve thermal stability and resilience, whereas too much instead lowers the heat resistance of the composition due to the presence of excess basic inorganic metal compound.

The above-described material may be used directly as the resin composition, or other ingredients may also be suitably included in the mixture. In either case, it is critical for the resin composition to have a melt index, as measured according to JIS K6760 at a test temperature of 190° C. and a test load of 21 N (2.16 kgf), of at least 1.0 dg/min, preferably at least 1.5 dg/min, and more preferably at least 2.0 dg/min. It is recommended that the upper limit be preferably 20 dg/min or less, and more preferably 15 dg/min or less. If the resin composition has a low melt index, the result will be a marked decline in processability.

It is preferable for the resin composition to have, in infrared absorption spectroscopy, a specific relative absorbance at the absorption peak attributable to carboxylate anion stretching vibrations at 1530 to 1630 $cm^{-1}$ with respect to the absorbance at the absorption peak attributable to carbonyl stretching vibrations normally detected at 1690 to 1710 $cm^{-1}$. This ratio may be expressed as follows: (absorbance at absorption peak attributable to carboxylate anion stretching vibrations)/(absorbance at absorption peak attributable to carbonyl stretching vibrations).

Here, "carboxylate anion stretching vibrations" refers to vibrations by carboxyl groups from which the proton has dissociated (metal ion-neutralized carboxyl groups), and "carbonyl stretching vibrations" refers to vibrations by undissociated carboxyl groups. The ratio between these respective peak intensities depends on the degree of neutralization. In the ionomer resins having a degree of neutralization of about 50 mol % which are commonly used, the ratio between these peak absorbances is about 1:1.

To improve the thermal stability, moldability and resilience of the material, it is recommended that the above resin composition have a peak absorbance attributable to carboxylate anion stretching vibrations which is preferably at least 1.5 times, and more preferably at least 2 times, the peak absorbance attributable to carbonyl stretching vibrations. The absence of any peaks attributable to carbonyl stretching vibrations is especially preferred.

The thermal stability of the above resin composition can be measured by thermogravimetry. It is recommended that, in thermogravimetry, the resin composition have a weight loss at 250° C., based on the weight of the mixture at 25° C., of preferably not more than 2 wt %, more preferably not more than 1.5 wt %, and even more preferably not more than 1 wt %.

It is recommended that the specific gravity of the resin composition proper, while not subject to any particular limitation, be preferably at least 0.9, but preferably not more than 1.5, more preferably not more than 1.3, and even more preferably not more than 1.1.

The resin composition is obtained by heating and mixing the above-described component (a) and/or component (d), with component (b) and component (c), and has an optimized melt index. It is recommended that preferably at least 70 molt, more preferably at least 80 molt, and even more preferably at least 90 molt, of the acid groups in the resin composition be neutralized. A high degree of neutralization makes it possible to more reliably suppress the exchange reactions that are a problem when only the above-described base resin and the fatty acid (or a derivative thereof) are used, thus preventing the formation of fatty acids. As a result, there can be obtained a material which has a greatly increased thermal stability and a good moldability, and which moreover has a much improved resilience compared with prior-art ionomer resins.

Here, with regard to neutralization of the resin composition, to more reliably achieve both a high degree of neutralization and good flow properties, it is recommended that the acid groups in the resin composition be neutralized with transition metal ions and with alkali metal and/or alkaline earth metal ions. Because transition metal ions have a weaker ionic cohesion than alkali metal and alkaline earth metal ions, it is possible in this way to neutralize some of the acid groups in the resin composition and thus enable the flow properties to be significantly improved.

The molar ratio between the transition metal ions and the alkali metal and/or alkaline earth metal ions is set as appropriate, preferably in a range of 10:90 to 90:10, and more preferably from 20:80 to 80:20. Too low a molar ratio of transition metal ions may fail to provide sufficient improvement in the flow properties of the resin composition. On the other hand, a molar ratio that is too high may lower the resilience.

Specific examples of such metal ions include zinc ions as the transition metal ions and at least one type of ion selected from among sodium, lithium, magnesium and calcium ions as the alkali metal or alkaline earth metal ions.

No particular limitation is imposed on the method used to obtain the resin composition in which the acid groups have been neutralized with transition metal ions and alkali metal or alkaline earth metal ions. Specific examples of methods of neutralization with transition metal ions, particularly zinc ions, include a method involving the use of a zinc soap as the fatty acid derivative, a method in which a zinc ion neutralization product is included as component (d) in the base resin (e.g., a zinc-neutralized ionomer resin), and a method in which zinc oxide is used as the basic inorganic metal compound serving as component (c).

As already noted, to obtain the innermost cover layer, it suffices to use the above resin composition as the essential ingredients, although various additives may be optionally included as well. For example, additives such as pigments, dispersants, antioxidants, ultraviolet absorbers and optical stabilizers may be included within the above resin composition. To improve the feel of the golf ball on impact, the resin composition may also include, in addition to the above essential ingredients, various non-ionomeric thermoplastic elastomers. Illustrative examples of such non-ionomeric thermoplastic elastomers include olefin elastomers, styrene elastomers, ester elastomers and urethane elastomers. The use of olefin elastomers and styrene elastomers is especially preferred.

It is preferable for the innermost cover layer to further include:

(e) a thermoplastic elastomer selected from the group consisting of thermoplastic polyester elastomers, thermoplastic block copolymers and thermoplastic urethanes, (f) a thermoplastic block copolymer containing end blocks modified by a functional group having reactivity with an ionomer resin, both end blocks being formed of different comonomers, and (g) an inorganic filler which is non-reactive with an ionomer resin.

Component (e)

Thermoplastic polyester elastomers that may be used as component (e) are composed primarily of hard segments which are high-melting crystalline polymer segments made up of crystalline aromatic polyester units, and soft segments which are low-melting polymer segments made up of aliphatic polyether units and/or aliphatic polyester units.

Preferred examples of the high-melting crystalline polymer include polybutylene terephthalates derived from terephthalic acid and/or dimethyl terephthalate in combination with 1,4-butanediol. Other illustrative examples include polyesters derived from a dicarboxylic acid component such as isophthalic acid, phthalic acid, naphthalene-2,6-dicarboxylic acid, naphthalene-2,7-dicarboxylic acid, diphenyl-4,4'-dicarboxylic acid, diphenoxyethanedicarboxylic acid, 5-sulfoisophthalic acid or ester-forming derivatives thereof in combination with a diol having a molecular weight of up to 300, such as an aliphatic diol (e.g., ethylene glycol, trimethylene glycol, pentamethylene glycol, hexamethylene glycol, neopentyl glycol, decamethylene glycol), an alicyclic diol (e.g., 1,4-cyclohexanedimethanol, tricyclodecanedimethylol), or an aromatic diol (e.g., xylylene glycol, bis(p-hydroxy) diphenyl, bis(p-hydroxy-phenyl)propane, 2,2-bis[4-(2-hydroxyethoxy)phenyl]propane, bis[4-(2-hydroxy)phenyl] sulfone, 1,1-bis[4-(2-hydroxyethoxy)-phenyl]cyclohexane, 4,4'-dihydroxy-p-terphenyl, 4,4'-dihydroxy-p-quarterphenyl). Use can also be made of copolymeric polyesters prepared from two or more of these dicarboxylic acid components and diol components. In addition, polycarboxylic acid components, polyoxy acid components and polyhydroxy components having a functionality of three or more may be copolymerized in component (e) within a range of up to 5 mol %.

The low-melting polymer segments are composed of aliphatic polyether units and/or aliphatic polyester units.

Illustrative examples of aliphatic polyether units include poly(ethylene oxide) glycol, poly(propylene oxide) glycol, poly(tetramethylene oxide) glycol, poly(hexamethylene oxide) glycol, copolymers of ethylene oxide and propylene oxide, ethylene oxide addition polymers of poly(propylene oxide) glycols, and copolymers of ethylene oxide and tetrahydrofuran. Illustrative examples of aliphatic polyester units include poly(ϵ-caprolactone), polyenantholactone, polycaprylolactone, poly(butylene adipate) and poly(ethylene adipate). Of the above polymers, in terms of the resilience characteristics of the resulting polyester block copolymer, poly (tetramethylene oxide) glycol, ethylene oxide addition polymers of poly(propylene oxide) glycol, poly(ϵ-caprolactone), poly(butylene adipate) and poly(ethylene adipate) are preferred. Poly(tetramethylene oxide) glycol is especially preferred.

The low-melting polymer segments have a number-average molecular weight in the copolymerized state of preferably about 300 to about 6,000.

Letting the combined amount of high-melting crystalline polymer segments and low-melting polymer segments which are copolymerized to form the thermoplastic polyester elastomer be 100 wt %, it is advantageous for the thermoplastic polyester elastomer to include at least 15 wt %, and preferably at least 50 wt %, but not more than 90 wt %, of the low-melting polymer segments. At a proportion of low-melting polymer segments that is higher than the above range, adequate melt characteristics suitable for injection molding may not be attainable, which can make it difficult to achieve uniform mixture during melt blending with the other components. On the other hand, if the proportion is too low, sufficient flexibility and resilience may not be achieved.

The above-described thermoplastic polyester elastomer is a copolymer composed primarily of the foregoing high-melting crystalline polymer segments and low-melting polymer segments. The thermoplastic polyester elastomer may be prepared by a known method without particular limitation. Exemplary methods of preparation include methods (i) to (v) below, any of which may be suitably used.

(i) A method in which a lower alcohol diester of a dicarboxylic acid, an excess amount of low-molecular-weight glycol, and the low-melting polymer segment component are subjected to transesterification in the presence of a catalyst, and the resulting reaction products are polycondensed.

(ii) A method in which a dicarboxylic acid, an excess amount of a glycol and the low-melting polymer segment component are subjected to esterification in the presence of a catalyst, and the resulting reaction products are polycondensed.

(iii) A method in which first the high-melting crystalline segments are prepared, then the low-melting segments are added thereto and a transesterification reaction is carried out to effect randomization.

(iv) A method in which the high-melting crystalline segments and the low-melting polymer segments are joined together using a chain linking agent.

(v) In cases where poly(ϵ-caprolactone) is used as the low-melting polymer segments, a method in which the high-melting crystalline segments are subjected to an addition reaction with ϵ-caprolactone monomer.

It is recommended that the above-described thermoplastic polyester elastomer have a hardness, as measured in accordance with ASTM D-2240 (Shore D hardness), of preferably at least 10, and more preferably at least 20, but preferably not more than 50, and more preferably not more than 40.

Moreover, it is advantageous for the above thermoplastic polyester elastomer to exhibit a high rebound resilience, as measured in accordance with British Standard 903 (BS 903), of preferably at least 40%, and more preferably at least 50%, but preferably not more than 90%. If the rebound resilience is too low, moldings obtained from the resin composition of the invention will have a low resilience, which may diminish the flight performance of golf balls made with such moldings.

It is desirable for the above thermoplastic polyester elastomer to have a flexural rigidity, as measured in accordance with JIS K-7106, which is relatively low, with a value of preferably at least 5 MPa, more preferably at least 10 MPa, and even more preferably at least 15 MPa, but preferably 250 MPa or less, more preferably 200 MPa or less, and even more preferably 150 MPa or less. If the flexural rigidity is too high, moldings obtained from the resin composition of the invention will be too rigid, which may worsen the feel on impact and the durability of golf balls made with such moldings.

Thermoplastic block copolymers that may be used as component (e) include those in which the hard segments are made of crystalline polyethylene blocks (C) and/or crystalline polystyrene blocks (S), and the soft segments are made of polybutadiene blocks (B), polyisoprene blocks (I), blocks of a relatively random copolymer of ethylene and butylene (EB) or blocks of a relatively random copolymer of ethylene and propylene (EP). Blocks of a. relatively random copolymer of ethylene and butylene (EB), and blocks of a relatively random copolymer of ethylene and propylene (EP) are preferred. Blocks of a relatively random copolymer of ethylene and butylene (EB) are especially preferred.

Illustrative examples of such thermoplastic block copolymers include S-EB-S, S-B-S, S-I-S, S-EB, S-EB-S-EB, S-EP-S, S-EB-C, S-B-C, S-I-C, S-EP-C, C-EB-C, C-B-C, C-I-C, C-EB, C-EB-C-EB and C-EP-C. Including crystalline polyethylene blocks (C) as the hard segments is advantageous from the standpoint of resilience. The use of S-EP-C is preferred, and the use of C-EB-C is especially preferred.

If the thermoplastic block copolymer is a C-EB-C or S-EB-C type block copolymer, this may be obtained by hydrogenating butadiene or a styrene-butadiene copolymer.

A polybutadiene in which bonding within the butadiene structure is characterized by the presence of block-like 1,4-polymer regions having a 1,4-bond content of at least 95 wt %, and in which the butadiene structure as a whole has a 1,4-bond content of at least 50 wt %, and preferably at least 80 wt %, may be suitably used here as the polybutadiene or styrene-butadiene copolymer subjected to hydrogenation.

The degree of hydrogenation (conversion of double bonds in the polybutadiene or styrene-butadiene copolymer to saturated bonds) in the hydrogenate is preferably from 60 to 100%, and more preferably from 90 to 100%. Too low a degree of hydrogenation may give rise to undesirable effects such as gelation in the blending step with other components such as an ionomer resin and, when the golf ball is formed, may compromise the weather resistance of the cover and the durability of the ball to impact.

In the thermoplastic block copolymer, the content of the hard segments is preferably from 10 to 50 wt %. If the content of hard segments is too high, the innermost cover layer may lack sufficient flexibility, making it difficult to effectively achieve the objects of the invention. On the other hand, if the content of hard segments is too low, the blend may have a poor moldability.

The thermoplastic block copolymer has a number-average molecular weight of preferably from 30,000 to 800,000. The thermoplastic block copolymer has a melt index at 230° C. of preferably 0.5 to 15 g/10 min, and more preferably 1 to 7 g/10 min. Outside of this range, problems such as weld lines, sink marks and short shots may arise during injection molding.

Thermoplastic polyurethane elastomers that may be used as component (e) preferably have a morphology composed of, in particular, a high-molecular-weight polyol compound which makes up the soft segments, a monomolecular chain extender which makes up the hard segments, and a diisocyanate.

The high-molecular-weight polyol compound is not subject to any particular limitation and may be, for example, a polyester polyol, a polyol polyol, a polyether polyol, a copolyester polyol or a polycarbonate polyol. Exemplary polyester polyols include polycaprolactone glycol, poly(ethylene-1,4-adipate) glycol and poly(butylene-1,4-adipate) glycol; exemplary copolyester polyols include poly(diethylene glycol adipate) glycol; exemplary polycarbonate polyols include (hexanediol-1,6-carbonate) glycol; and exemplary polyether polyols include polyoxytetramethylene glycol.

These high-molecular-weight polyol compounds have a number-average molecular weight of about 600 to about 5,000, and preferably about 1,000 to about 3,000.

The aliphatic or aromatic diisocyanate in the cover may be suitably used as the diisocyanate. Illustrative examples include hexamethylene diisocyanate (HDI), 2,2,4- and 2,4,4-trimethylhexamethylene diisocyanate (TMDI), lysine diisocyanate (LDI), tolylene diisocyanate (TDI) and diphenylmethane diisocyanate (MDI). For a good compatibility when blending with other resins, the use of hexamethylene diisocyanate (HDI) or diphenylmethane diisocyanate (MDI) is preferred.

The monomolecular chain extender, which is not subject to any particular limitation, may be an ordinary polyhydric alcohol or polyamine. Specific examples include 1,4-butylene glycol, 1,2-ethylene glycol, 1,3-propylene glycol, 1,6-hexylene glycol, 1,3-butylene glycol, dicyclohexylmethylmethanediamine (hydrogenated MDI) and isophoronediamine (IPDA).

The above thermoplastic polyurethane elastomer has a JIS A hardness of preferably at least 70, more preferably at least 80, even more preferably at least 90, and most preferably at least 95, but preferably not more than 100, more preferably not more than 99, and even more preferably not more than 98. At a JIS A hardness below 70, the ball may take on excessive spin when hit with a driver, shortening the distance traveled. No particular limitation is imposed on the specific gravity of the thermoplastic polyurethane elastomer, so long as it is suitably adjusted within a range where the objects of the invention are attainable. The specific gravity is preferably between 1.0 and 1.3, and more preferably between 1.1 and 1.25.

A commercial product may be used as the above-described thermoplastic polyurethane elastomer. Illustrative examples include Pandex TR3080, Pandex T7298, Pandex EX7895, Pandex T7890 and Pandex T8198 (all manufactured by DIC Bayer Polymer, Ltd.).

Component (f)

Next, the thermoplastic block copolymer which contains end blocks modified by a functional group having reactivity with an ionomer resin, wherein both end blocks are formed of different comonomers, and serves as component (f) is described.

The thermoplastic block copolymer serving as the base of component (f) is exemplified by block copolymers of the following types: $H_1$-$S_1$, $H_1$-$S_1$-$H_1$-$S_1$, $H_1$-$(S_1$-$H_1)_n$-$S_1$ and $H_1$-$S_1$—$H_2$ (wherein $H_1$ and $H_2$ are hard segments, and $S_1$ is a soft segment). In particular, the use of an $H_1$-$S_1$, type di-block copolymer or an $H_1$-$S_1$-$H_2$ type tri-block copolymer is preferred. The use of an $H_1$-$S_1$-$H_2$ type tri-block copolymer is more preferred. Compared with the use of other block copolymers, graft copolymers and random copolymers, the compatibility can be markedly improved.

Hard segments that may be used in component (f) are exemplified by crystalline olefin blocks, aromatic vinyl compound blocks, polyester blocks and polyamide blocks. In particular, effective improvement in the compatibility is achieved with the use of preferably crystalline olefin blocks, aromatic vinyl compound blocks or polyester blocks, and more preferably crystalline olefin blocks or aromatic vinyl compound blocks. Crystalline olefin blocks are exemplified by crystalline ethylene blocks (C) and crystalline propylene blocks. The use of crystalline ethylene blocks is especially preferred. Preferred use may be made of styrene blocks (S) as the aromatic vinyl compound blocks, of polytetramethylene terephthalate blocks (PBT) as the polyester blocks, and of nylon blocks as the polyamide blocks.

Soft segments that may be used include polybutadiene blocks (B), polyisoprene blocks (I), blocks of a relatively random copolymer of ethylene and butylene (EB), and blocks of a relatively random copolymer of ethylene and propylene (EP). The use of blocks of a relatively random copolymer of ethylene and butylene (EB) or blocks of a relatively random copolymer of ethylene and propylene (EP) is preferred. The use of blocks of a relatively random copolymer of ethylene and butylene (EB) is especially preferred.

The thermoplastic block copolymer used as component (f) is made of blocks, with the blocks at either end of the copolymer being formed of different comonomers. Illustrative examples of such thermoplastic block copolymers include S-EB-C, S-B-C, S-I-C, S-EB, S-EB-S-EB, S-EP-C, PBT-S-EB and PBT-S-EB-C. To more effectively improve the compatibility of the ionomer resin and the thermoplastic elastomer, it is preferable to use S-EB-C or PBT-S-EB, and more preferable to use S-EB-C.

If the thermoplastic block copolymer is an S-EB-C type block copolymer, it can be obtained by hydrogenating a styrene-butadiene copolymer.

A polybutadiene in which bonding within the butadiene structure is characterized by the presence of block-like 1,4-polymer regions having a 1,4-bond content of at least 95 wt %, and in which the butadiene structure as a whole has a 1,4-bond content of at least 50 wt %, and preferably at least 80 wt %, may be suitably used here as the polybutadiene or styrene-butadiene copolymer in hydrogenation.

The degree of hydrogenation (conversion of double bonds in the polybutadiene or styrene-butadiene copolymer to saturated bonds) in the hydrogenate of the styrene-butadiene copolymer is preferably at least 60%, and more preferably at least 90%, with an upper limit of preferably 100%. Too low a degree of hydrogenation may give rise to undesirable effects such as gelation in the blending step with other components such as an ionomer resin and, when the golf ball is formed, may compromise the weather resistance of the cover and the durability of the ball to impact.

In the above block copolymer having crystalline olefin blocks, the content of the hard segments is preferably from 10 to 50 wt %. If the content of hard segments is too high, the innermost cover layer may lack sufficient flexibility, making it difficult to effectively achieve the objects of the invention. On the other hand, if the content of hard segments is too low, the resulting blend may have a poor moldability.

The block copolymer having such crystalline olefin blocks has a number-average molecular weight of preferably from 30,000 to 800,000.

In the practice of the invention, only the end blocks on the thermoplastic block copolymer are modified with functional groups. The compatibility can be very effectively improved in this way compared with when only intermediate blocks are modified, when both intermediate blocks and end blocks are modified, or when modification is carried out along the entire molecule, as in random copolymers.

The end block modifying method is preferably a method in which only the ends of the molecule are modified. This has the advantage that more functional groups than necessary do not react with the ionomer resin and increase the viscosity of the mixture. Moreover, the compatibility can be very effectively improved because the molecular ends of the block copolymer bond with the ionomer resin.

If the functional groups which react with an ionomer resin have too high a reactivity, the viscosity will decrease, whereas a reactivity which is too low will lower the compatibility-improving effect. Hence, it is preferable for the functional groups to have a moderate degree of reactivity. Examples of such functional groups that may be used include, in order of decreasing preference, amino groups, acid anhydride groups, and epoxy groups. Amino groups are especially preferred.

The thermoplastic block copolymer has a melt index at 230° C. of preferably from 0.5 to 15 g/10 min, and more preferably from 1 to 7 g/10 min. Outside of this range, problems such as weld lines, sink marks and short shots may arise during injection molding.

The above components are compounded in a weight ratio of (base resin a+d)/e/f of 50 to 80/50 to 20/4 to 20. In this ratio, the amount of component (a) is preferably at least 60%, more preferably at least 65%, and even more preferably at least 70%, but preferably not more than 75%. The amount of component (e) is preferably at least 23%, and more preferably at least 25%, but preferably not more than 40%, and more preferably not more than 30%. The amount of component (f) is preferably at least 5%, but preferably not more than 15%, more preferably not more than 10%, and even more preferably not more than 7%. Outside of these ranges, resilience cannot be achieved and the compatibility worsens, as a result of which laminar separation may arise.

Component (g)

In addition, an inorganic filler which is non-reactive with ionomer resins may also be added in an amount of from 10 to 30 parts by weight per 100 parts by weight of the base polymer.

In such a case, to effectively improve the durability of the cover composition, the average particle size of the inorganic filler is preferably at least 0.01 μm, more preferably at least 0.05 μm, and even more preferably at least 0.1 μm, but preferably not more than 5 μm, more preferably not more than 3 μm, and even more preferably not more than 1 μm.

To adjust the specific gravity of the cover composition, the specific gravity of the inorganic filler is preferably at least 2, and more preferably at least 4, but preferably not more than 7, and more preferably not more than 5.

Whether the inorganic filler is indeed "non-reactive with ionomer resins" is verified by the absence of foaming and a large rise in viscosity when the inorganic filler is melt-mixed with an ionomer resin. For example, when inorganic filler in an amount such as may be used in the invention is added to a typical ionomer resin available under the trade name "Himilan 1605" and mixed therewith at 200° C. for 5 minutes, if foaming does not arise and the melt index after mixing is 1 or more, the inorganic filler may be regarded as having no reactivity with the ionomer resin.

Examples of such inorganic fillers include barium sulfate, titanium dioxide and hard clay. Barium sulfate is especially preferred. The use of precipitated barium sulfate is preferred because of its particle size stability.

Outermost Cover Layer Material

A thermoplastic resin, a thermoset resin or the like may be used as the outermost cover layer material. Specifically, the outermost cover layer may be made of a known material such as a thermoplastic or thermoset polyurethane, ionomer resin, polyester elastomer or polyamide elastomer. It is especially preferable for the outermost cover layer material to be made primarily of a thermoplastic polyurethane because golf balls having an excellent scuff resistance and having an excellent spin stability on shots known as "fliers" can be thereby obtained.

The thermoplastic polyurethane is not subject to any particular limitation, provided it is a thermoplastic elastomer composed primarily of polyurethane. However, thermoplastic polyurethanes with a structure that includes soft segments made of a high-molecular-weight polyol compound, hard segments made of a chain extender, and a diisocyanate are preferred.

Any high-molecular-weight polyol compound employed in the prior art relating to thermoplastic polyurethane materials may be used without particular limitation. Preferred examples include polyester polyols, polyether polyols, copolyester polyols and polycarbonate polyols. Of these, polyether polyols are preferred for the preparation of thermoplastic polyurethanes having excellent rebound resilience and low-temperature properties, and polyester polyols are preferred for the heat resistance and broad molecular design capabilities they provide.

Any diisocyanate employed in the prior art relating to thermoplastic polyurethane materials may be used without particular limitation. Illustrative examples include 4,4'-diphenylmethane diisocyanate, 2,4-toluene diisocyanate, 2,6-toluene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, dimer acid diisocyanate, 2,2,4- and 2,4,4-trimethylhexamethylene diisocyanate and lysine diisocyanate. However, depending on the type of isocyanate, the crosslinking reaction during injection molding may be difficult to control. In the practice of the invention, the use of 4,4'-diphenylmethane diisocyanate is preferred for good compatibility with the subsequently described isocyanate mixture.

Any chain extender employed in the prior art relating to thermoplastic polyurethane materials may be used without particular limitation. For instance, use may be made of any ordinary polyol or polyamine. Specific examples include 1,4-butylene glycol, 1,2-ethylene glycol, 1,3-butanediol, 1,6-hexanediol, 2,2-dimethyl-1,3-propanediol, dicyclohexylmethylmethanediamine (hydrogenated MDI) and isophoronediamine (IPDA). These chain extenders have a number-average molecular weight of generally at least 20, but generally not more than 15,000.

No limitation is imposed on the specific gravity of the thermoplastic polyurethane, so long as it is suitably adjusted within a range that allows the objects of the invention to be achieved. The specific gravity is preferably at least 1.0, and more preferably at least 1.1, but preferably not more than 1.3, and more preferably not more than 1.25.

The thermoplastic polyurethane used in the invention may be a commercial product. Illustrative examples include Pandex T8290, Pandex T8295 and Pandex T8260 (all manufactured by DIC Bayer Polymer, Ltd.), and Resamine 2593 and Resamine 2597 (both manufactured by Dainichi Seika Colour & Chemicals Mfg. Co., Ltd.).

The resin which forms the above cover layer may be composed of the above-described thermoplastic polyurethane. A type of polyurethane in which the molecule has a partially crosslinked structure is preferred. The use of at least one type selected from the following two types of polyurethanes (first polyurethane, second polyurethane) is especially preferred for further enhancing the scuff resistance.

First Polyurethane

A thermoplastic polyurethane composition composed of the above-described thermoplastic polyurethane (A) and an isocyanate mixture (B) is used.

The isocyanate mixture (B) is preferably one prepared by dispersing (b-1) a compound having as functional groups at least two isocyanate groups per molecule in (b-2) a thermoplastic resin that is substantially non-reactive with isocyanate. The compound having as functional groups at least two isocyanate groups per molecule which serves as component (b-1) may be an isocyanate compound used in the prior art relating to polyurethanes, examples of which include aromatic isocyanates, hydrogenated aromatic isocyanates, aliphatic diisocyanates and alicyclic diisocyanates. Specific examples include isocyanate compounds such as those mentioned above. From the standpoint of reactivity and work safety, the use of 4,4'-diphenylmethane diisocyanate is preferred.

The thermoplastic resin that is substantially non-reactive with isocyanate which serves as component (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester thermoplastic elastomers (e.g., polyether-ester block copolymers, polyester-ester block copolymers).

For good rebound resilience and strength, the use of a polyester thermoplastic elastomer is especially preferred. No particular limitation is imposed on the polyester thermoplastic elastomer, provided it is a thermoplastic elastomer composed primarily of polyester. The use of a polyester-based block copolymer composed primarily of high-melting crystalline polymer segments made of crystalline aromatic polyester units and low-melting polymer segments made of aliphatic polyether units and/or aliphatic polyester units is preferred. In addition, up to 5 molt of polycarboxylic acid ingredients, polyoxy ingredients and polyhydroxy ingredients having a functionality of three or more may be copolymerized. In the low-melting polymer segments made of aliphatic polyether units and/or aliphatic polyester units, illustrative examples of the aliphatic polyether include poly(ethylene oxide) glycol, poly(propylene oxide) glycol, poly(tetramethylene oxide) glycol, poly(hexamethylene oxide) glycol, copolymers of ethylene oxide and propylene oxide, ethylene oxide addition polymers of poly(propylene oxide) glycols, and copolymers of ethylene oxide and tetrahydrofuran. Illustrative examples of the aliphatic polyester include poly(ϵ-caprolactone), polyenantholactone, polycaprylolactone, poly(butylene adipate) and poly(ethylene adipate). Examples of polyester thermoplastic elastomers preferred for use in the invention include those in the Hytrel series made by DuPont-Toray Co., Ltd., and those in the Primalloy series made by Mitsubishi Chemical Corporation.

When the isocyanate mixture (B) is prepared, it is desirable for the relative proportions of above components (b-1) and (b-2), expressed as the weight ratio (b-1)/(b-2), to be within a range of 100/5 to 100/100, and especially 100/10 to 100/40. If the amount of component (b-1) relative to component (b-2) is too low, more isocyanate mixture (B) must be added to achieve an amount of addition adequate for the crosslinking reaction with the thermoplastic polyurethane (A). In such cases, component (b-2) exerts a large influence, which may compromise the physical properties of the thermoplastic polyurethane composition serving as the cover stock. If, on the other hand, the amount of component (b-1) is too high, component (b-1) may cause slippage to occur during mixing, making it difficult to prepare the thermoplastic polyurethane composition used as the cover stock.

The isocyanate mixture (B) can be prepared by blending component (b-1) into component (b-2) and thoroughly working together these components at a temperature of 130 to 250° C. using a mixing roll mill or a Banbury mixer, then either pelletizing or cooling and grinding. The isocyanate mixture (B) used may be a commercial product, a preferred example of which is Crossnate EM30 (made by Dainichi Seika Colour & Chemicals Mfg. Co., Ltd.). Above component (B) is included in an amount, per 100 parts by weight of component (A), of generally at least 1 part by weight, preferably at least 5 parts by weight, and more preferably at least 10 parts by weight, but generally not more than 100 parts by weight, preferably not more than 50 parts by weight, and more preferably not more than 30 parts by weight. Too little component (B) may make it impossible to achieve a sufficient crosslinking reaction, so that there is no apparent enhancement of the physical properties. On the other hand, too much may result in greater discoloration over time or due to the effects of heat and ultraviolet light, and may also have other undesirable effects, such as lowering the rebound.

Second Polyurethane

At least one of the cover layers is made of a molded resin composition consisting primarily of (A) a thermoplastic polyurethane and (B) a polyisocyanate compound. The resin composition has present therein a polyisocyanate compound within at least a portion of which all the isocyanate groups on the molecule remain in an unreacted state. Golf balls made with such a thermoplastic polyurethane have an excellent rebound, spin performance and scuff resistance.

The outermost cover layer is composed mainly of a thermoplastic polyurethane, and is formed of a resin composition of primarily (A) a thermoplastic polyurethane and (B) a polyisocyanate compound.

To fully exhibit the advantageous effects of the invention, a necessary and sufficient amount of unreacted isocyanate groups should be present in the outermost cover layer-forming resin material. Specifically, it is recommended that the combined weight of above components A and B together be at least 60%, and preferably at least 70%, of the total weight of the cover layer. Components A and B are described in detail below.

The thermoplastic polyurethane serving as component A has a structure which includes soft segments made of a polymeric polyol (polymeric glycol) that is a long-chain polyol, and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of a cyclic ether. The polyether polyol may be used singly or as a combination of two or more thereof. Of these, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made of a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight computed based on the hydroxyl number measured in accordance with JIS K-1557.

Suitable chain extenders include those used in the prior art relating to thermoplastic polyurethanes. For example, low-molecular-weight compounds which have a molecular weight of 400 or less and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

The polyisocyanate compound is not subject to any particular limitation, although use may be made of one that is used in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component A to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of activated hydrogen atoms to isocyanate groups in the above polyurethane-forming reaction can be adjusted within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the thermoplastic polyurethane used as component A. Production may be carried out by either a prepolymer process or one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

Illustrative examples of the thermoplastic polyurethane serving as component A include commercial products such as Pandex T8295, Pandex T8290 and Pandex T8260 (all available from DIC Bayer Polymer, Ltd.).

Next, concerning the polyisocyanate compound used as component B, it is critical that, in at least some of the polyisocyanate compound in the single resin composition, all the isocyanate groups on the molecule remain in an unreacted state. That is, polyisocyanate compound in which all the isocyanate groups on the molecule are in a completely free state must be present within the single resin composition, and such a polyisocyanate compound may be present together with polyisocyanate compound in which some of the isocyanate groups on the molecule are in a free state.

Various types of isocyanates may be employed without particular limitation as this polyisocyanate compound. Illustrative examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable for achieving a good balance between the influence on processability of such effects as the rise in viscosity that accompanies the reaction with the thermoplastic polyurethane serving as component A and the physical properties of the resulting golf ball cover material.

In the practice of the invention, although not an essential constituent, a thermoplastic elastomer other than the above-described thermoplastic polyurethane may be included as component C together with components A and B. Including this component C in the above resin composition enables the flow properties of the resin composition to be further improved and enables various properties required of golf ball cover materials, such as resilience and scuff resistance, to be increased.

Component C, which is a thermoplastic elastomer other than the above thermoplastic polyurethane, is exemplified by one or more thermoplastic elastomer selected from among polyester elastomers, polyamide elastomers, ionomer resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because, owing to reactions with isocyanate groups, the resilience and scuff resistance are enhanced while retaining a good manufacturability.

The relative proportions of above components A, B and C are not subject to any particular limitation, although to fully achieve the advantageous effects of the invention, it is preferable for the weight ratio A:B:C of the respective components to be from 100:2:50 to 100:50:0, and more preferably from 100:2:50 to 100:30:8.

In the practice of the invention, the resin composition is prepared by mixing component A with component B, and additionally mixing in also component C. It is critical to select the mixing conditions such that, of the polyisocyanate compound, at least some polyisocyanate compound is present in which all the isocyanate groups on the molecule remain in an unreacted state. For example, treatment such as mixture in an inert gas (e.g., nitrogen) or in a vacuum state must be furnished. The resin composition is then injection-molded around a core which has been placed in a mold. To smoothly and easily handle the resin composition, it is preferable for the composition to be formed into pellets having a length of 1 to 10 mm and a diameter of 0.5 to 5 mm. Isocyanate groups in an unreacted state remain in these resin pellets; the unreacted isocyanate groups react with component A or component C to form a crosslinked material while the resin composition is being injection-molded about the core, or due to post-treatment such as annealing.

The above method of molding the outermost cover layer is exemplified by feeding the above-described resin composition to an injection molding machine, and injecting the molten resin composition around the core so as to form a cover layer. The molding temperature varies according to such factors as the type of thermoplastic polyurethane, but is typically in a range of 150 to 250° C.

When injection molding is carried out, it is desirable though not essential to carry out molding in a low-humidity environment such as by purging with a low-temperature gas using an inert gas such as nitrogen or low dew-point dry air or by vacuum treating some or all places on the resin paths from the resin feed area to the mold interior. Illustrative, non-limiting examples of the medium used for transporting the resin include low-moisture gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the resin molded part, thus making it possible to reduce variable factors such as an unwanted rise in viscosity and enabling the effective crosslinking efficiency to be enhanced.

Techniques that could be used to confirm the presence of polyisocyanate compound in an unreacted state within the resin composition prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin composition (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin composition has been molded as described above, its properties as a golf ball cover can be further improved by carrying out annealing so as to induce the crosslinking reaction to proceed further. "Annealing," as used herein, refers to aging the cover in a fixed environment for a fixed length of time.

In addition to the above resin components, various optional additives may be included in the outermost cover layer material in the present invention. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide, tungsten).

When such additives are included, the amount of the additives is suitably selected from a range within which the objects of the invention are achievable, although it is preferable for such additives to be included in an amount, per 100 parts by weight of the thermoplastic polyurethane serving as an essential component of the invention, of preferably at least 0.1 part by weight, and more preferably at least 0.5 part by weight, but preferably not more than 10 parts by weight, and more preferably not more than 5 parts by weight.

Molding of the cover using the thermoplastic polyurethane of the invention may be carried out by using an injection-molding machine to mold the cover over the intermediate layer which encases the core. Molding is carried out at a molding temperature of generally from 150 to 250° C.

Intermediate Cover Layer Material

Illustrative, non-limiting, examples of the intermediate cover layer material include thermoplastic or thermoset polyurethane elastomers, polyester elastomers, ionomer resins, highly neutralized ionomer resins and polyolefin elastomers. These may be used singly or as mixtures of two or more thereof. The use of an ionomer resin or a highly neutralized ionomer resin is preferred. It is desirable for at least one intermediate cover layer to be made of a resin composition which includes as the essential ingredients above-described components (a) to (d).

Next, the hardnesses of the respective cover layers are described.

The innermost cover layer has a Shore D hardness of preferably at least 38, more preferably at least 42, and even more preferably at least 44, but preferably not more than 55, more preferably not more than 53, and even more preferably not more than 51. The innermost cover layer is softer than the hardest cover layer, the Shore D hardness difference therebetween being preferably more than 2, more preferably more than 5, and even more preferably more than 7. At a Shore D hardness difference therebetween of less than 2, the deflection by the ball under a specific load may become small, giving the ball a poor feel on impact, although this depends also on the balance with the core deflection under a specific load. The upper limit in the Shore D hardness difference is preferably not more than 20, more preferably not more than 15, and even more preferably not more than 10.

The outermost cover layer has a Shore D hardness of preferably at least 40, more preferably at least 44, and even more preferably at least 46, but preferably not more than 57, more preferably not more than 55, and even more preferably not more than 53. The outermost cover layer is softer than the hardest cover layer, with the Shore D hardness difference therebetween being preferably more than 1, and more preferably more than 2. At a Shore D hardness difference therebetween of less than 1, the outside of the ball is hard, which may result in a poor controllability. The upper limit in the Shore D hardness difference is preferably 18 or less, more preferably 15 or less, and even more preferably 12 or less.

At least one layer of the intermediate cover layers is harder than the innermost cover layer and the outermost cover layer. Its Shore D hardness, non-limiting, is preferably 70 or less, more preferably 68 or less, and even more preferably 65 or less, but preferably at least 45, more preferably at least 47, and even more preferably at least 50. At a Shore D hardness above 58, the feel of the ball on impact worsens, the spin rate on approach shots falls, and the controllability is poor. On the other hand, at a Shore D hardness of less than 45, the resilience may be poor.

In the practice of the invention, the combined thickness of the cover layers (the sum of the respective thicknesses of the innermost, intermediate and outermost layers) must be at least 3.5, and is preferably at least 4.5 mm, and more preferably at least 5 mm. The upper limit in the combined thickness of the cover layers is preferably 8 mm or less, more preferably 7 mm or less, and even more preferably 6 mm or less. At a total cover layer thickness greater than 8 mm, the feel on impact may worsen. On the other hand, at a total cover layer thickness of less than 3.5 mm, the spin rate on shots with a driver becomes excessive, as a result of which the ball assumes a high trajectory and thus becomes subject to wind effects.

The innermost cover layer has a thickness of preferably at least 1.6 mm, more preferably at least 2.2 mm, and even more preferably at least 2.6 mm, but preferably not more than 3.2 mm, more preferably not more than 3.1 mm, and even more preferably not more than 3.0 mm. At a thickness greater than 3.2 mm, the feel on impact may worsen, whereas at a thickness less than 1.6 mm, the spin rate on shots with a driver may become excessive, possibly causing the ball to assume a high trajectory which may make it more subject to wind effects.

The intermediate cover layer has a thickness of preferably at least 0.8 mm, and more preferably at least 0.9 mm, but preferably not more than 1.5 mm, and more preferably not more than 1.3 mm.

The outermost cover layer has a thickness of preferably at least 0.7 mm, and more preferably at least 0.8 mm, but preferably not more than 1.5 mm, and more preferably not more than 1.3 mm.

Specific Gravity Difference

The specific gravity difference between the core and the innermost cover layer is preferably less than 0.1, more preferably less than 0.09. and even more preferably less than 0.08. If the difference between the specific gravity of the core and the specific gravity of the innermost cover layer is larger than the range indicated above, the center of gravity for the core will not coincide with the center of gravity for the ball, thus destabilizing the roll and the spin behavior of the ball. Moreover, such a ball design is poorly suited for mass production.

Hardness Difference between Core Center Hardness and Innermost Cover Layer

In the practice of the invention, the difference between the Shore D hardness (A) at the center of the core and the Shore D hardness (B) of the innermost cover layer must be optimized so as to satisfy the condition $A>B-10$. The hardness is designed so that preferably A>B−8, and more preferably A>B−6. At A<B−10, the durability of the ball to impact worsens.

Dimples

The cover has a plurality of dimples on the surface thereof. The number of dimples is preferably at least 250, more preferably at least 300, and even more preferably at least 350, but preferably not more than 430, more preferably not more than 410, and even more preferably not more than 390. Within this range, the ball readily incurs lift forces, enabling the distance traveled by the ball, particularly on shots with a driver, to be increased. To better increase the surface coverage ratio of the dimples, it is recommended that the dimples be formed in preferably at least four types of mutually differing diameter and/or depth, more preferably at least five types, and even more preferably at least 6 types, but preferably not more than 20 types, more preferably not more than 15 types, and even more preferably not more than 12 types. The dimples are preferably formed so as to be circular as viewed from above, and have an average diameter of preferably at least 3.0 mm, more preferably at least 3.3 mm, and even more preferably at least 3.5 mm, but preferably not more than 4.7 mm, more preferably not more thane 4.4 mm, and even more preferably not more than 4.0 mm. To achieve an appropriate trajectory, it is desirable for the dimples to have an average depth of preferably at least 0.140 mm, more preferably at least 0.145 mm, and even more preferably at least 0.150 mm, but preferably not more than 0.185 mm, more preferably not more than 0.180 mm, and even more preferably not more than 0.174 mm. As used herein, "average diameter" refers to the mean value for the diameters of all the dimples, and "average depth" refers to the mean value for the depths of all the dimples. The diameter of a dimple is measured as the distance across the dimple between positions where the dimple region meets land (non-dimple) regions, that is, between the highest points of the dimple region. The golf ball is usually painted, in which case the dimple diameter refers to the diameter when the surface of the ball has been covered with paint. The depth of a dimple is measured by connecting together the positions where the dimple meets the surrounding land so as to define an imaginary plane, and determining the vertical distance from a center position on the plane to the bottom (deepest position) of the dimple.

As described above, in the multi-piece solid golf ball of the invention, the ball rebound has been further improved and the spin rate on shots with a driver has been sufficiently reduced, thus increasing the distance traveled by the ball. In particular, on shots taken with a driver at a high head speed, the ball has a high initial velocity and thus travels farther. The ball also has an excellent spin performance on approach shots.

EXAMPLES

The following Examples of the invention and Comparative Examples are provided by way of illustration and not by way of limitation.

Examples 1 to 3

Solid cores were produced by preparing core compositions using the formulations shown in Table 1 (Examples 1-3), Table 2 (Examples 4-9) and Table 3 (Comparative Examples 1-6) below, then molding and vulcanizing the compositions under vulcanization conditions of 155° C. and 15 minutes. Two cover layers—an innermost cover layer and an intermediate cover layer—were then injection-molded over these cores from formulations A, B, C and D shown in Table 4. Next, an outermost cover layer H was applied as shown below over the resulting three-layer spheres, thereby giving four-piece golf balls.

In Example and Comparative Example, the various starting materials shown in column H of Table 4 (units: parts by weight) were kneaded in a nitrogen atmosphere with a twin-screw extruder to form cover resin compositions. These resin compositions were in the form of pellets having a length of 3 mm and a diameter of 1 to 2 mm.

The sphere encased by the intermediate cover layer was placed within an injection molding mold, and above cover material H was injection-molded over the sphere, thereby forming four-piece golf balls having a 1.0 mm thick outermost cover layer according to Examples and Comparative Examples. The cover properties were measured by preparing a 2 mm thick injection-molded sheet of the material, subjecting the sheet to 8 hours of annealing treatment at 100° C., then letting the annealed sheet stand at room temperature for one week.

TABLE 1

| | | Example | | |
|---|---|---|---|---|
| | | 1 | 2 | 3 |
| Core composition | 1,4-cis Polybutadiene | 100 | 100 | 100 |
| | 1,1-Bis(tert-butylperoxy)cyclohexane | 0.3 | 0.3 | 0.3 |
| | Dicumyl peroxide | 0.3 | 0.3 | 0.3 |
| | 2,2'-Methylenebis(4-methyl-6-t-butylphenol) | 0.1 | 0.1 | 0.1 |
| | Zinc diacrylate | 35.5 | 35.5 | 35.5 |
| | Zinc oxide | 5 | 5 | 5 |
| | Barium sulfate | 14.9 | 13.9 | 16.0 |
| | Zinc salt of pentachlorothiophenol | 1 | 1 | 1 |
| | Zinc stearate | 5 | 5 | 5 |
| Innermost cover layer | Composition A | 80 | 80 | 80 |
| | Composition B | 0 | 0 | 0 |
| | Composition D | 0 | 0 | 0 |
| | Thermoplastic polyester | 15 | 15 | 15 |
| | Hydrogenated butadiene | 5 | 5 | 5 |
| | Barium sulfate | 21 | 21 | 21 |
| | Magnesium stearate | 1 | 1 | 1 |
| Intermediate cover layer | Composition A | 0 | 0 | 0 |
| | Composition B | 0 | 0 | 0 |

TABLE 1-continued

| | | Example | | |
|---|---|---|---|---|
| | | 1 | 2 | 3 |
| | Composition C | 0 | 0 | 0 |
| | Composition D | 100 | 100 | 100 |
| Outermost cover layer | Composition H | 100 | 100 | 100 |
| Core | Diameter (mm) | 33.7 | 34.9 | 32.6 |
| | Weight (g) | 23.5 | 26.0 | 21.4 |
| | Deflection (mm) | 2.9 | 2.9 | 2.9 |
| | Center hardness (Shore D) | 45 | 45 | 45 |
| | Specific gravity | 1.17 | 1.17 | 1.18 |
| Innermost cover layer | Thickness (mm) | 2.3 | 1.7 | 2.85 |
| | Hardness (Shore D) | 49 | 49 | 49 |
| | Specific gravity | 1.12 | 1.12 | 1.12 |
| Intermediate cover layer | Thickness (mm) | 1.2 | 1.2 | 1.2 |
| | Hardness (Shore D) | 61 | 61 | 61 |
| Outermost cover layer | Thickness (mm) | 1.0 | 1.0 | 1.0 |
| | Hardness (Shore D) | 47 | 47 | 47 |
| Ball | Diameter (mm) | 42.7 | 42.7 | 42.7 |
| | Weight (g) | 45.4 | 45.4 | 45.4 |
| | Deflection (mm) | 2.1 | 2.1 | 2.1 |
| | Number of dimples | 378 | 378 | 378 |
| | Average diameter of dimples (mm) | 3.8 | 3.8 | 3.8 |
| | Average depth of dimples (mm) | 0.159 | 0.159 | 0.159 |
| | Number of dimple types | 10 | 10 | 10 |
| | Initial velocity on shots with driver (m/s) | 81.0 | 81.1 | 80.9 |
| | Spin rate on shots with driver (rpm) | −169 | −130 | −181 |
| | Spin rate on approach shots (rpm) | −111 | −75 | −123 |

TABLE 2

| | | Example | | | | | |
|---|---|---|---|---|---|---|---|
| | | 4 | 5 | 6 | 7 | 8 | 9 |
| Core composition | 1,4-cis Polybutadiene | 100 | 100 | 100 | 100 | 100 | 100 |
| | 1,1-Bis(tert-butylperoxy)-cyclohexane | 0.3 | 0.3 | 0.3 | 0.3 | 0.3 | 0.3 |
| | Dicumyl peroxide | 0.3 | 0.3 | 0.3 | 0.3 | 0.3 | 0.3 |
| | 2,2'-Methylenebis(4-methyl-6-t-butylphenol) | 0.1 | 0.1 | 0.1 | 0.1 | 0.1 | 0.1 |
| | Zinc diacrylate | 35.5 | 35.5 | 36 | 35.5 | 35.5 | 35.5 |
| | Zinc oxide | 5 | 5 | 5 | 5 | 5 | 5 |
| | Barium sulfate | 14.9 | 13.9 | 15.8 | 16.0 | 16.0 | 16.9 |
| | Zinc salt of pentachlorothiophenol | 1 | 1 | 1 | 1 | 1 | 1 |
| | Zinc stearate | 5 | 5 | 5 | 5 | 5 | 5 |
| Innermost cover layer | Composition A | 80 | 80 | 80 | 80 | 80 | 100 |
| | Composition B | 0 | 0 | 0 | 0 | 0 | 0 |
| | Composition C | 0 | 0 | 0 | 0 | 0 | 0 |
| | Thermoplastic polyester | 15 | 15 | 15 | 15 | 15 | 0 |
| | Hydrogenated butadiene | 5 | 5 | 5 | 5 | 5 | 0 |
| | Barium sulfate | 21 | 21 | 21 | 21 | 21 | 24 |
| | Magnesium stearate | 1 | 1 | 1 | 1 | 1 | 1 |
| Intermediate cover layer | Composition A | 0 | 0 | 100 | 50 | 0 | 0 |
| | Composition B | 100 | 100 | 0 | 0 | 100 | 100 |
| | Composition C | 0 | 0 | 0 | 0 | 0 | 0 |
| | Composition D | 0 | 0 | 0 | 50 | 0 | 0 |
| Outermost cover layer | Composition H | 100 | 100 | 100 | 100 | 100 | 100 |
| Core | Diameter (mm) | 33.7 | 34.9 | 32.6 | 32.6 | 32.6 | 32.6 |
| | Weight (g) | 23.5 | 26.0 | 21.4 | 21.4 | 21.4 | 21.4 |
| | Deflection (mm) | 2.9 | 2.9 | 2.8 | 3.0 | 2.9 | 2.9 |
| | Center hardness (Shore D) | 45 | 45 | 45 | 45 | 45 | 45 |
| | Specific gravity | 1.17 | 1.17 | 1.18 | 1.18 | 1.18 | 1.18 |
| Innermost cover layer | Thickness (mm) | 2.3 | 1.7 | 2.85 | 2.85 | 2.85 | 2.85 |
| | Hardness (Shore D) | 49 | 49 | 49 | 49 | 49 | 48 |
| | Specific gravity | 1.12 | 1.12 | 1.12 | 1.12 | 1.12 | 1.12 |
| Intermediate cover layer | Thickness (mm) | 1.2 | 1.2 | 1.2 | 1.2 | 1.2 | 1.2 |
| | Hardness (Shore D) | 56 | 56 | 52 | 56 | 56 | 56 |
| Outermost cover layer | Thickness (mm) | 1.0 | 1.0 | 1.0 | 1.0 | 1.0 | 1.0 |
| | Hardness (Shore D) | 47 | 47 | 47 | 47 | 47 | 47 |
| Ball | Diameter (mm) | 42.7 | 42.7 | 42.7 | 42.7 | 42.7 | 42.7 |
| | Weight (g) | 45.4 | 45.4 | 45.4 | 45.4 | 45.4 | 45.4 |

TABLE 2-continued

| | Example | | | | | |
|---|---|---|---|---|---|---|
| | 4 | 5 | 6 | 7 | 8 | 9 |
| Deflection (mm) | 2.3 | 2.3 | 2.3 | 2.3 | 2.3 | 2.3 |
| Number of dimples | 378 | 378 | 378 | 378 | 378 | 378 |
| Average diameter of dimples (mm] | 3.8 | 3.8 | 3.8 | 3.8 | 3.8 | 3.8 |
| Average depth of dimples (mm) | 0.159 | 0.159 | 0.159 | 0.159 | 0.159 | 0.159 |
| Number of dimple types | 10 | 10 | 10 | 10 | 10 | 10 |
| Initial velocity on shots with driver (m/s) | 80.7 | 80.8 | 80.9 | 80.9 | 80.8 | 81 |
| Spin rate on shots with driver (rpm) | −44 | −23 | −4 | −39 | −42 | −35 |
| Spin rate on approach shots (rpm) | +166 | +162 | +142 | +171 | +166 | +173 |

TABLE 3

| | | Comparative Example | | | | | |
|---|---|---|---|---|---|---|---|
| | | 1 | 2 | 3 | 4 | 5 | 6 |
| Core composition | 1,4-cis Polybutadiene | 100 | 100 | 100 | 100 | 100 | 100 |
| | 1,1-Bis(tert-butylperoxy)-cyclohexane | 0.3 | 0.3 | 0.3 | 0.3 | 0.3 | 0.3 |
| | Dicumyl peroxide | 0.3 | 0.3 | 0.3 | 0.3 | 0.3 | 0.3 |
| | 2,2'-Methylenebis(4-methyl-6-t-butylphenol) | 0.1 | 0.1 | 0.1 | 0.1 | 0.1 | 0.1 |
| | Zinc diacrylate | 36 | 30 | 35 | 30 | 34 | 35.5 |
| | Zinc oxide | 5 | 5 | 5 | 5 | 5 | 5 |
| | Barium sulfate | 12.6 | 18.4 | 13.0 | 17.3 | 15.6 | 13.9 |
| | Zinc salt of pentachlorothiophenol | 1 | 1 | 1 | 1 | 1 | 1 |
| | Zinc stearate | 5 | 5 | 5 | 5 | 5 | 5 |
| Innermost cover layer | Composition A | 80 | 80 | 0 | 80 | 0 | 0 |
| | Composition B | 0 | 0 | 0 | 0 | 0 | 0 |
| | Composition C | 0 | 0 | 100 | 0 | 100 | 100 |
| | Thermoplastic polyester | 15 | 15 | 0 | 15 | 0 | 0 |
| | Hydrogenated butadiene | 5 | 5 | 0 | 5 | 0 | 0 |
| | Barium sulfate | 21 | 21 | 22 | 21 | 22 | 22 |
| | Magnesium stearate | 1 | 1 | 0 | 1 | 0 | 0 |
| Intermediate cover layer | Composition A | 0 | 0 | 0 | 0 | 0 | 0 |
| | Composition B | 0 | 0 | 100 | 100 | 100 | 100 |
| | Composition C | 100 | 0 | 0 | 0 | 0 | 0 |
| | Composition D | 0 | 100 | 0 | 0 | 0 | 0 |
| Outermost cover layer | Composition H | 100 | 100 | 100 | 100 | 100 | 100 |
| Core | Diameter (mm) | 36.4 | 32.6 | 36.4 | 33.7 | 33.7 | 34.9 |
| | Weight (g) | 29.4 | 21.4 | 29.4 | 23.5 | 23.5 | 26.0 |
| | Deflection (mm) | 2.8 | 3.8 | 3.0 | 3.8 | 3.0 | 2.9 |
| | Center hardness (Shore D) | 45 | 38 | 44 | 38 | 44 | 45 |
| | Specific gravity | 1.16 | 1.18 | 1.16 | 1.17 | 1.17 | 1.17 |
| Innermost cover layer | Thickness (mm) | 0.95 | 2.85 | 0.95 | 2.3 | 2.3 | 1.7 |
| | Hardness (Shore D) | 49 | 49 | 55 | 49 | 55 | 55 |
| | Specific gravity | 1.12 | 1.12 | 1.12 | 1.12 | 1.12 | 1.12 |
| Intermediate cover layer | Thickness (mm) | 1.2 | 1.2 | 1.2 | 1.2 | 1.2 | 1.2 |
| | Hardness (Shore D) | 56 | 61 | 56 | 56 | 56 | 56 |
| Outermost cover layer | Thickness (mm) | 1.0 | 1.0 | 1.0 | 1.0 | 1.0 | 1.0 |
| | Hardness (Shore D) | 47 | 47 | 47 | 47 | 47 | 47 |
| Ball | Diameter (mm) | 42.7 | 42.7 | 42.7 | 42.7 | 42.7 | 42.7 |
| | Weight (g) | 45.4 | 45.4 | 45.4 | 45.4 | 45.4 | 45.4 |
| | Deflection (mm) | 2.3 | 3.0 | 2.3 | 3.0 | 2.3 | 2.3 |
| | Number of dimples | 378 | 378 | 378 | 378 | 378 | 378 |
| | Average diameter of dimples (mm) | 3.8 | 3.8 | 3.8 | 3.8 | 3.8 | 3.8 |
| | Average depth of dimples (mm) | 0.159 | 0.159 | 0.159 | 0.159 | 0.159 | 0.159 |
| | Number of dimple types | 10 | 10 | 10 | 10 | 10 | 10 |
| | Initial velocity on shots with driver (m/s) | 81.7 | 78.8 | 80.5 | 78.9 | 80.0 | 80.3 |
| | Spin rate on shots with driver (rpm) | 0 | −236 | +29 | −70 | −43 | −4 |
| | Spin rate on approach shots (rpm) | 0 | −152 | +155 | −166 | +170 | +156 |

Details on the core materials are provided below. The numbers in the tables indicate parts by weight.

Polybutadiene: Produced by JSR Corporation under the trade name "BR730"

1,1-Bis(tert-butylperoxy)cyclohexane: 40% dilution produced by NOF Corporation

Dicumyl peroxide: Produced by NOF Corporation 2,2'-Methylenebis(4-methyl-6-t-butylphenol): Produced by Ouchi Shinko Chemical Industry Co., Ltd.

Zinc diacrylate: Produced by Nihon Jyoryu Kogyo Co., Ltd.

Zinc oxide: Produced by Sakai Chemical Industry Co., Ltd.

Barium sulfate: Produced by Sakai Chemical Industry Co., Ltd. under the trade name "Chinkosei Barium #100"

Zinc stearate: Produced by NOF Corporation

Details of the ingredients included in the innermost cover layer material are provided below.

Thermoplastic polyester: A thermoplastic polyester elastomer produced by Mitsubishi Chemical Corporation under the trade name "Primalloy N2800"

Hydrogenated butadiene: A terminal amino-modified S-EB-C type thermoplastic block copolymer produced by JSR Corporation under the trade name "Dynaron 4630P"

Barium sulfate: Produced by Sakai Chemical Industry Co., Ltd. under the trade name "Chinkosei Barium #300"

Magnesium stearate: Produced by NOF Corporation (Uji Sangyo) under the trade name "Nissan Magnesium Stearate"

TABLE 4

| Formulation | A | B | C | D | H |
|---|---|---|---|---|---|
| Nucrel AN4318 | 100 | | | | |
| Himilan 1605 | | 65 | 35 | 50 | |
| Himilan 1706 | | | | 50 | |
| Surlyn 9945 | | | 35 | | |
| Dynaron 6100P | | 31.25 | 30 | | |
| Polytail H | | 2 | | 4 | |
| Behenic acid | | 18 | | | |
| Magnesium stearate | 20 | | 0.31 | | |
| Calcium stearate | | 0.15 | 0.0018 | | |
| Zinc stearate | | 0.15 | 0.0018 | | |
| Magnesium oxide | 1.5 | | | | |
| Calcium hydroxide | | 2.3 | | | |
| Trimethylolpropane | | | 1 | | |
| Titanium dioxide | | | 0.48 | | |
| Titanium yellow | | | 0.005 | | |
| Phthalocyanine blue | | | 0.003 | | |
| Carbon black | | | 0.0003 | | |
| Pandex 8295 | | | | | 25 |
| Pandex 8290 | | | | | 75 |
| Thermoplastic polyether-ester elastomer | | | | | 15 |
| Polyisocyanate compound | | | | | 9 |

Numbers in the table indicate parts by weight.

Trade names for the principle materials appearing in the above table are given below.

Nucrel AN4318: A ternary copolymer produced by DuPont-Mitsui Polychemicals Co., Ltd.

Himilan 1605: A zinc ionomer of a binary copolymer. Produced by DuPont-Mitsui Polychemicals Co., Ltd. Shore D hardness, 65.

Himilan 1706: A sodium ionomer of a binary copolymer. Produced by DuPont-Mitsui Polychemicals Co., Ltd. Shore D hardness, 64.

Surlyn 9945: A zinc ionomer of a binary copolymer. Produced by E.I. DuPont de Nemours & Co. Shore D hardness, 62.

Dynaron: An olefinic thermoplastic elastomer produced by JSR Corporation.

Behenic acid: Produced by NOF Corporation under the trade name "NAA-222S (powder)"

Polytail H: A low-molecular-weight polyolefin polyol produced by Mitsubishi Chemical Corporation.

Calcium hydroxide: Produced by Shiraishi Calcium Kaisha, Ltd. under the trade name "CLS-B"

Pandex: An MDI-PTMG type thermoplastic polyurethane produced by DIC-Bayer Polymer.

Titanium dioxide: Produced by Ishihara Sangyo Kaisha, Ltd. under the trade name "Tipaque R550"

Polyisocyanate compound: 4,4-Diphenylmethane diisocyanate.

Thermoplastic polyether-ester elastomer: Produced by DuPont-Toray Co., Ltd. under the trade name "Hytrel 4001"

The thickness, hardness and the like of the core and the individual cover layers are measured by the following measuring method, and the flight performance and approach spin property of the balls are evaluated by the following method. The results are shown in Tables.

Hardness of Individual Cover Layers

The Shore D hardnesses of the cover materials (resin compositions) in the form of sheets, as measured according to ASTM D-2240.

Core and Ball Deflection (mm)

The deflection (mm) when a spherical body is compressed under a final load of 1,275 N (130 kgf) from an initial load state of 98 N (10 kgf).

Initial Velocity of Ball (m/s)

The initial velocity of the ball when hit at a head speed of 54.8 m/s with a driver ("TourStage X-Drive 405", manufactured by Bridgestone Sports Co., Ltd.) mounted on a swing robot.

Spin Rate of Ball (rpm)

The spin rate was measured under the same conditions as mentioned above, and the difference of the measured value with respect to a reference value of "0" for the measured value obtained in Comparative Example 1 was indicated.

Spin Rate on Approach Shots (rpm)

The spin rate on approach shots taken with, as the club, a "TourStage TP600" at a head speed of 26 m/s using a swing robot was measured. The difference of the measured value with respect to a reference value of "0" for the measured value obtained in Comparative Example 1 was indicated.

It is apparent from these test results that, compared with the golf balls obtained in Comparative Examples 1 to 6 which fall outside the scope of the invention, the golf balls obtained in Examples 1 to 9 which fall within the scope of the invention exhibited a spin rate-lowering effect on shots with a driver and had an excellent spin rate on approach shots.

Examples 10 to 14

The rubber composition (inner layer) formulated as shown in Table 5 was vulcanized at 155° C. for 17 minutes, following which the surface was trimmed, thereby producing an inner core layer. In a separate procedure, the rubber composition (outer layer) formulated as shown in Table 5 (parts by weight) was rendered into sheets while in an unvulcanized state, thereby producing a pair of outer core layer-forming sheets, and the sheets were shaped with a die having hemispherical protrusions. The outer core layer-forming sheets of unvulcanized rubber shaped by the mold cavity were then placed over the inner core layer and vulcanized at 155° C. for 15 minutes, following which the surface was trimmed, thereby producing a two-layer core composed of an inner layer and an outer layer.

Using formulations in Table 4, two cover layers—namely, the innermost cover layer and the intermediate cover layer—were then injection-molded over the above-described two-layer core. Next, as shown below, the resulting four-layer sphere was encased by the outermost cover layer H, thereby giving a five-layer golf ball. The other conditions were the same as the conditions used in Examples 1 to 5 of the invention. The results are shown in Table 6.

TABLE 5

| | | Example | | | | |
|---|---|---|---|---|---|---|
| | | 10 | 11 | 12 | 13 | 14 |
| Core composition 1 | 1,4-cis Polybutadiene | 100 | 100 | 100 | 100 | 100 |
| | 1,1-Bis(tert-butylperoxy)cyclohexane | 0.3 | 0.3 | 0.3 | 0.3 | 0.3 |
| | Dicumyl peroxide | 0.3 | 0.3 | 0.3 | 0.3 | 0.3 |
| | 2,2'-Methylenebis(4-methyl-6-t-butylphenol) | 0.1 | 0.1 | 0.1 | 0.1 | 0.1 |
| | Zinc diacrylate | 27.5 | 27.5 | 27.5 | 27.5 | 27.5 |
| | Zinc oxide | 5 | 5 | 5 | 5 | 5 |
| | Barium sulfate | 19.5 | 19.5 | 19.5 | 19.5 | 19.5 |
| | Zinc salt of pentachlorothiophenol | 1 | 1 | 1 | 1 | 1 |
| | Zinc stearate | 5 | 5 | 5 | 5 | 5 |
| Core composition 2 | 1,4-cis Polybutadiene | 100 | 100 | 100 | 100 | 100 |
| | 1,1-Bis(tert-butylperoxy)cyclohexane | 0.3 | 0.3 | 0.3 | 0.3 | 0.3 |
| | Dicumyl peroxide | 0.3 | 0.3 | 0.3 | 0.3 | 0.3 |
| | 2,2'-Methylenebis(4-methyl-6-t-butylphenol) | 0.1 | 0.1 | 0.1 | 0.1 | 0.1 |
| | Zinc diacrylate | 35.5 | 35.5 | 35.5 | 35.5 | 35.5 |
| | Zinc oxide | 5 | 5 | 5 | 5 | 5 |
| | Barium sulfate | 16.0 | 16.0 | 16.0 | 16.0 | 16.0 |
| | Zinc salt of pentachlorothiophenol | 1 | 1 | 1 | 1 | 1 |
| | Zinc stearate | 5 | 5 | 5 | 5 | 5 |
| Cover layer 1 | Formulation A | 80 | 80 | 80 | 80 | 100 |
| | Formulation B | 0 | 0 | 0 | 0 | 0 |
| | Formulation C | 0 | 0 | 0 | 0 | 0 |
| | Thermoplastic polyester | 15 | 15 | 15 | 15 | 0 |
| | Hydrogenated butadiene | 5 | 5 | 5 | 5 | 0 |
| | Barium sulfate | 21 | 21 | 21 | 21 | 24 |
| | Magnesium stearate | 1 | 1 | 1 | 1 | 1 |
| Cover layer 2 | Formulation A | 0 | 100 | 50 | 0 | 0 |
| | Formulation B | 0 | 0 | 0 | 100 | 100 |
| | Formulation D | 100 | 0 | 50 | 0 | 0 |
| Cover layer 3 | Formulation H | 100 | 100 | 100 | 100 | 100 |

TABLE 6

| | | Example | | | | |
|---|---|---|---|---|---|---|
| | | 10 | 11 | 12 | 13 | 14 |
| Inner core layer | Diameter (mm) | 26 | 26 | 26 | 26 | 26 |
| | Weight (g) | 10.9 | 10.9 | 10.9 | 10.9 | 10.9 |
| | Deflection (mm) | — | — | — | — | — |
| | Center hardness (Shore D) | 43 | 43 | 43 | 43 | 43 |
| | Surface hardness (Shore D) | 51 | 51 | 51 | 51 | 51 |
| | Specific gravity | 1.18 | 1.18 | 1.18 | 1.18 | 1.18 |
| Two-layer core (inner layer + outer layer) | Outer layer thickness (mm) | 3.3 | 3.3 | 3.3 | 3.3 | 3.3 |
| | Diameter (mm) | 32.6 | 32.6 | 32.6 | 32.6 | 32.6 |
| | Weight (g) | 21.4 | 21.4 | 21.4 | 21.4 | 21.4 |
| | Cross-sectional hardness 1 mm from boundary (Shore D) | 60 | 60 | 60 | 60 | 60 |
| | Surface hardness (Shore D) | 64 | 64 | 64 | 64 | 64 |
| | Deflection (mm) | 2.9 | 2.8 | 3 | 2.9 | 2.9 |
| | Specific gravity | 1.18 | 1.18 | 1.18 | 1.18 | 1.18 |
| Cover layer 1 | Thickness (mm) | 2.85 | 2.85 | 2.85 | 2.85 | 2.85 |
| | Hardness (Shore D) | 49 | 49 | 49 | 49 | 48 |
| | Specific gravity | 1.12 | 1.12 | 1.12 | 1.12 | 1.12 |
| Cover layer 2 | Thickness (mm) | 1.2 | 1.2 | 1.2 | 1.2 | 1.2 |
| | Hardness (Shore D) | 61 | 52 | 56 | 56 | 56 |
| | Thickness (mm) | 1.0 | 1.0 | 1.0 | 1.0 | 1.0 |
| | Hardness (Shore D) | 47 | 47 | 47 | 47 | 47 |
| Cover layer 3 | Diameter (mm) | 42.7 | 42.7 | 42.7 | 42.7 | 42.7 |
| | Weight (g) | 45.4 | 45.4 | 45.4 | 45.4 | 45.4 |
| Ball | Deflection (mm) | 2.1 | 2.3 | 2.3 | 2.3 | 2.3 |
| | Number of dimples | 378 | 378 | 378 | 378 | 378 |

TABLE 6-continued

| | Example | | | | |
|---|---|---|---|---|---|
| | 10 | 11 | 12 | 13 | 14 |
| Average diameter of dimples (mm) | 3.8 | 3.8 | 3.8 | 3.8 | 3.8 |
| Average depth of dimples (mm) | 0.159 | 0.159 | 0.159 | 0.159 | 0.159 |
| Number of dimple types | 10 | 10 | 10 | 10 | 10 |
| Initial velocity on shots with driver (m/s) | 80.9 | 80.8 | 80.8 | 80.6 | 80.9 |
| Spin rate on shots with driver (rpm) | −221 | −45 | −75 | −82 | −76 |
| Spin rate on approach shots (rpm) | −142 | +72 | +100 | +91 | +102 |

The invention claimed is:

1. A multi-piece solid golf ball comprising a core obtained by molding under heat a rubber composition comprising a base rubber, a filler, an organic peroxide, an antioxidant and an α,β-unsaturated carboxylic acid, and a cover of at least three layers which encases the core and in which the cover layers other than an outermost cover layer are formed primarily of a thermoplastic resin, wherein the core has a deflection when compressed under a final load of 1,275 N (130 kgf) from an initial load state of 98 N (10 kgf) of 3.2 mm or less; at least one intermediate cover layer situated between an innermost cover layer and an outermost cover layer has a higher hardness than the innermost cover layer and the outermost cover layer; the innermost cover layer and the core have a difference in specific gravity therebetween of 0.1 or less; the core has a Shore D center hardness (A) which satisfies the following condition with respect to the Shore D hardness (B) of the innermost cover layer:

$$A>B-10;$$

the cover layers have a combined thickness of at least 3.5 mm; and the innermost cover layer is made of a resin composition comprising:

100 parts by weight of one or a mixture of (a) an olefin-unsaturated carboxylic acid random copolymer and/or an olefin-unsaturated carboxylic acid-unsaturated carboxylic acid ester random copolymer, and (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 150 parts by weight of a fatty acid or fatty acid derivative having a molecular weight of at least 228, and (c) from 0.1 to 10 parts by weight of a basic inorganic metal compound which is capable of neutralizing acid groups in components (a) and/or (d) and in component (b).

2. The multi-piece solid golf ball of claim 1, wherein at least one intermediate cover layer situated between the innermost cover layer and the outermost cover layer is made of a resin composition comprising said components (a) to (d).

3. The multi-piece solid golf ball of claim 1, wherein the resin composition making up the innermost cover layer further comprises:

(e) a thermoplastic elastomer selected from the group consisting of thermoplastic polyester elastomers, thermoplastic block copolymers and thermoplastic urethanes, (f) a thermoplastic block copolymer containing end blocks modified by a functional group having reactivity with an ionomer resin, both end blocks being formed of different comonomers, and (g) an inorganic filler which is non-reactive with an ionomer resin.

4. The multi-piece solid golf ball of claim 1 wherein, of components (a) and (d), the resin material which is an olefin-unsaturated carboxylic acid random copolymer (binary random copolymer) and/or a metal salt thereof has a Shore D hardness of 58 or more, and the resin material which is an olefin-unsaturated carboxylic acid-unsaturated carboxylic acid ester random copolymer (ternary random copolymer) and/or a metal salt thereof has a Shore D hardness of 55 or less.

5. The multi-piece solid golf ball of claim 1, wherein the core is composed of an inner sphere and an outer core layer, the inner sphere having a center hardness in Shore D units of from 21 to 46, a surface hardness in Shore D units of from 33 to 56, and a Shore D hardness difference between the surface and the center of at least 5, and the outer core layer having a cross-sectional hardness 1 mm outside of a boundary between the inner sphere and the outer core layer, in Shore D units, of from 43 to 66, and having a surface hardness in Shore D units of from 50 to 70.

6. The multi-piece solid golf ball of claim 1, wherein the outermost cover layer is formed primarily of polyurethane.

7. The multi-piece solid golf ball of claim 1, wherein the outermost cover layer is formed primarily of a thermoplastic polyurethane.

* * * * *